US012644243B2

(12) United States Patent
Vigneault et al.

(10) Patent No.: US 12,644,243 B2
(45) Date of Patent: Jun. 2, 2026

(54) WIDTH-ADJUSTABLE SCRAPER BLADE DEVICE

(71) Applicant: 9407-4895 QUEBEC INC., Plessisville (CA)

(72) Inventors: Jimmy Vigneault, Plessisville (CA); Patrick Faucher, Plessisville (CA)

(73) Assignee: 9407-4895 QUEBEC INC., Plessisville (CA)

( * ) Notice: Subject to any disclaimer, the term of this patent is extended or adjusted under 35 U.S.C. 154(b) by 1003 days.

(21) Appl. No.: 17/724,798

(22) Filed: Apr. 20, 2022

(65) Prior Publication Data

US 2022/0243411 A1 Aug. 4, 2022

Related U.S. Application Data

(63) Continuation of application No. PCT/CA2020/051503, filed on Nov. 5, 2020.

(60) Provisional application No. 62/930,927, filed on Nov. 5, 2019.

(51) Int. Cl.
*E01H 5/06* (2006.01)

(52) U.S. Cl.
CPC ..... *E01H 5/065* (2013.01); *E01H 5/062* (2013.01)

(58) Field of Classification Search
CPC .... E01H 5/00; E01H 5/02; E01H 5/04; E01H 5/06; E01H 5/061; E01H 5/062; E01H 5/065
USPC ..... 37/296, 219, 232
See application file for complete search history.

(56) References Cited

U.S. PATENT DOCUMENTS

| | | | |
|---|---|---|---|
| 263,178 | A | 8/1882 | Hesselbom |
| 520,479 | A | 5/1894 | Bunnell |
| 1,383,409 | A | 7/1921 | Liddell |
| 1,665,733 | A | 4/1928 | Clark |
| 1,783,941 | A | 12/1930 | Bunch |
| 2,055,291 | A | 9/1936 | Henry |
| 2,078,310 | A | 4/1937 | Berres |
| 2,116,351 | A | 5/1938 | Jones |
| 2,218,512 | A | 10/1940 | Ball |
| 2,337,434 | A | 12/1943 | Washbond |

(Continued)

FOREIGN PATENT DOCUMENTS

| | | | |
|---|---|---|---|
| CA | 1009034 | A | 4/1977 |
| CA | 2750723 | A1 | 2/2012 |

(Continued)

OTHER PUBLICATIONS

Machine translation in English of CA2750723.

(Continued)

*Primary Examiner* — Christopher J Sebesta
*Assistant Examiner* — Evan A Bregel
(74) *Attorney, Agent, or Firm* — Ziolkowski Patent Solutions Group, SC

(57) ABSTRACT

The scraper blade device is adjustable in width and can be used for cleaning a roadway surface. It includes a main transversal support and an elongated moldboard. The moldboard includes two partially overlapping elongated moldboard units. The scraper blade device also includes a plurality of blade segments that can be tilted with reference to one another to follow profile variations of the roadway surface. This, among other things, allows the efficiency of the cleaning to be preserved even when the scraper blade device becomes very large when fully extended.

8 Claims, 19 Drawing Sheets

(56) References Cited

U.S. PATENT DOCUMENTS 2,587,719 A 3/1952 Fratini
2,697,289 A 12/1954 Standfuss
2,775,830 A 1/1957 Kenyon
2,962,821 A 12/1960 Peitl
2,967,364 A 1/1961 Warner et al.
3,011,273 A 12/1961 Stumpt
3,199,234 A 8/1965 Reissinger
3,231,991 A 2/1966 Wandscheer et al.
3,400,475 A 9/1968 Peitl
3,465,456 A 9/1969 Meyer
3,539,022 A 11/1970 Berg
3,547,203 A 12/1970 Jackoboice
3,772,803 A 11/1973 Cote
3,793,752 A 2/1974 Snyder
3,807,064 A 4/1974 Schmidt, Jr.
3,808,714 A 5/1974 Reissinger et al.
3,901,329 A 8/1975 Eftefield
3,911,601 A 10/1975 Maheu
4,031,966 A 6/1977 Farrell
4,071,966 A 2/1978 Cohen
4,073,077 A 2/1978 Essel et al.
4,074,448 A 2/1978 Niemela
4,208,812 A 6/1980 Brownly
4,248,311 A 2/1981 Frisbee et al.
4,249,322 A 2/1981 McLaughlin et al.
4,249,323 A 2/1981 Mathis et al.
4,275,514 A 6/1981 Maura
4,281,721 A 8/1981 Beales
4,306,625 A 12/1981 Davis
4,307,523 A 12/1981 Reissinger et al.
4,369,847 A 1/1983 Mizunuma
4,424,871 A 1/1984 Stickney
4,562,891 A 1/1986 Ranner
4,570,366 A 2/1986 Yost
4,597,202 A 7/1986 Weeks
4,667,426 A 5/1987 Howard et al.
4,669,205 A * 6/1987 Smathers ..... E01H 5/063 37/232
4,885,852 A 12/1989 Gudmundsson
5,140,763 A 8/1992 Nichols, IV
5,191,729 A 3/1993 Verseef
5,265,356 A 11/1993 Winter
5,344,254 A 9/1994 Sartain
5,392,538 A 2/1995 Geerligs et al.
5,437,113 A 8/1995 Jones
5,634,523 A 6/1997 Kobayashi et al.
5,697,172 A 12/1997 Verseef
5,720,122 A 2/1998 McLellan
5,743,032 A 4/1998 Vauhkonen
5,749,114 A 5/1998 Miller, Jr. et al.
5,819,443 A 10/1998 Winter
5,819,444 A 10/1998 Desmarais
5,870,839 A 2/1999 Wissmiller
5,894,689 A 4/1999 Turk
5,899,007 A 5/1999 Niemela et al.
5,921,010 A 7/1999 Schulte et al.
5,921,326 A 7/1999 Ragule
5,987,785 A 11/1999 Aguado et al.
6,035,944 A 3/2000 Neuner et al.
6,073,371 A 6/2000 Goos et al.
6,154,986 A 12/2000 Hadler et al.
6,163,985 A 12/2000 Chinnery et al.
6,240,660 B1 6/2001 Dugas
6,408,549 B1 6/2002 Quenzi et al.
6,412,199 B1 7/2002 Quenzi et al.
6,442,877 B1 * 9/2002 Quenzi ..... E01H 5/065 37/281
6,467,553 B1 10/2002 Wojanis
6,618,965 B1 9/2003 Schultz et al.
6,701,646 B2 3/2004 Schultz et al.
6,751,894 B2 6/2004 Verseef
6,813,848 B2 11/2004 Ortamala
6,817,118 B2 11/2004 Schmeichel
6,823,615 B2 11/2004 Strait
6,877,258 B2 4/2005 Frey
6,892,480 B1 5/2005 Gledhill et al.
6,895,698 B2 5/2005 Hollinrake et al.
7,089,692 B2 8/2006 Strait
7,100,311 B2 9/2006 Verseef
7,100,314 B1 9/2006 Jensen
7,107,709 B2 9/2006 Hamel
7,134,227 B2 11/2006 Quenzi et al.
7,171,770 B2 2/2007 Schultz et al.
7,429,158 B2 9/2008 McFarland
7,467,485 B2 12/2008 Lachance et al.
7,493,710 B2 2/2009 Frey et al.
7,543,401 B2 6/2009 Hughes
7,555,853 B2 7/2009 Paonessa
7,578,078 B2 * 8/2009 Gandolfi ..... E01H 5/066 172/815
7,631,441 B2 12/2009 Hunt
7,640,682 B1 1/2010 Buckbee
7,658,022 B2 2/2010 Strait
7,658,236 B2 2/2010 Howson et al.
7,681,335 B2 3/2010 Schmeichel
7,681,337 B2 3/2010 Watson
7,730,643 B2 6/2010 Mishra et al.
7,743,536 B2 6/2010 Evans et al.
7,841,109 B2 11/2010 Stevens et al.
8,014,289 B2 9/2011 Noble
8,096,066 B2 1/2012 Gandolfi
8,127,471 B2 3/2012 Stevens et al.
8,176,661 B2 5/2012 Brame
8,342,256 B2 1/2013 Adams et al.
8,776,405 B2 7/2014 Paonessa
8,793,907 B2 8/2014 Walimaa et al.
8,887,413 B2 11/2014 Miller
8,887,827 B2 11/2014 Simpson
9,051,700 B2 6/2015 Summers et al.
9,169,617 B2 10/2015 Behan et al.
9,200,418 B2 12/2015 Jones et al.
9,255,371 B1 2/2016 Jordan
9,441,338 B2 9/2016 Courcelles
9,528,234 B1 12/2016 Pigeon
9,611,604 B2 4/2017 Vigneault
10,106,942 B2 10/2018 Roberge
10,428,478 B2 10/2019 Sankovic et al.
10,480,140 B2 11/2019 Vigneault
11,203,852 B2 12/2021 Vigneault
2003/0066738 A1 4/2003 Veenhof
2003/0226289 A1 * 12/2003 Geerligs ..... E01H 5/06 37/268
2005/0126052 A1 6/2005 Ono et al.
2006/0005435 A1 1/2006 Gamble, II et al.
2009/0200048 A1 8/2009 Frederick
2013/0174452 A1 7/2013 Diehl et al.
2014/0250740 A1 9/2014 Supergan
2015/0040441 A1 2/2015 Nammensma
2015/0101216 A1 4/2015 Kerr et al.
2017/0218585 A1 * 8/2017 Vigneault ..... E01H 5/062

FOREIGN PATENT DOCUMENTS

CA 2723630 C 4/2017
CH 313333 A 4/1956
CH 382207 A 9/1964
CH 678344 A5 8/1991
CN 2903176 Y 5/2007
CN 203346934 U 12/2013
CN 103498444 A 1/2014
CN 203530909 U 4/2014
CN 204199229 U 3/2015
CN 205100150 U 3/2016
CN 205387727 U 7/2016
DE 1299675 B 7/1969
DE 3711988 A1 10/1988
DE 8811708 U1 5/1989
DE 4441654 C2 2/1996
DE 3608893 C2 12/1997
EP 0849401 B1 3/2002
EP 1247906 A2 10/2002
EP 2154294 A1 2/2010
EP 2662493 B1 12/2018
FR 1050311 A 1/1954

(56) References Cited

FOREIGN PATENT DOCUMENTS

| | | | |
|---|---|---|---|
| FR | 2179703 | A | 11/1973 |
| FR | 2349683 | A1 | 11/1977 |
| FR | 2448599 | A1 | 9/1980 |
| GB | 402584 | A | 12/1933 |
| GB | 766042 | A | 1/1957 |
| GB | 1015307 | A | 12/1965 |
| JP | 55061623 | A | 5/1980 |
| JP | 4077776 | B2 | 4/2008 |
| JP | 6004904 | B2 | 10/2016 |
| KR | 200422656 | Y1 | 7/2006 |
| KR | 101046258 | B1 | 7/2011 |
| KR | 101361482 | B1 | 2/2014 |
| KR | 102109035 | B1 | 5/2020 |
| WO | 2010015992 | A2 | 2/2010 |
| WO | 2021087612 | A1 | 5/2021 |

OTHER PUBLICATIONS

Machine translation in English of CH313333.
Machine translation in English of CH382207.
Machine translation in English of CH678344.
Machine translation in English of CN2903176.
Machine translation in English of CN103498444.
Machine translation in English of CN203346934.
Machine translation in English of CN203530909.
Machine translation in English of CN204199229.
Machine translation in English of CN205100150.
Machine translation in English of CN205387727.
Machine translation in English of DE1299675.
Machine translation in English of DE3608893.
Machine translation in English of DE3711988.
Machine translation in English of DE4441654.
Machine translation in English of DE8811708.
Machine translation in English of EP-849401.
Machine translation in English of EP1247906.
Machine translation in English of FR1050311.
Machine translation in English of FR2179703.
Machine translation in English of FR2349683.
Machine translation in English of FR2448599.
Machine translation in English of JP55061623.
Machine translation in English of JP4077776.
Machine translation in English of JP6004904.
Machine translation in English of KR200422656.
Machine translation in English of KR101046258.
Machine translation in English of KR101361482.
Machine translation in English of KR102109035.

* cited by examiner

WIDTH-ADJUSTABLE SCRAPER BLADE DEVICE

CROSS REFERENCE TO PRIOR APPLICATIONS

The present case is a continuation of PCT/CA2020/051503 filed 5 Nov. 2020. PCT/CA2020/051503 claims the benefits of U.S. patent application Ser. No. 62/930,927 filed 5 Nov. 2019. The entire contents of these prior patent applications are hereby incorporated by reference.

TECHNICAL FIELD

The technical field relates generally to scraper blade devices and methods of cleaning roadway surfaces, such as roadway surfaces covered with snow, ice, etc.

TECHNICAL BACKGROUND

One example of a surface to be cleaned is a roadway surface on which snow and ice accumulated. These materials are hereafter generically referred to in a non-limitative manner as frozen water materials. Removing them is traditionally done using a rigid blade having a lowermost edge in engagement with the roadway surface. This blade is frequently referred to as a snowplow blade and is generally attached to a vehicle, for instance a truck or the like, that can move it over the roadway surface. Such concept, among other things, can work very well if the roadway surfaces are always perfectly smooth, flat and free of imperfections. In practice, roadway surfaces are not. For instance, the surface height profile often varies irregularly from one end of the lowermost edge of the blade to the other, and the surface height profile varies all the time when the blade moves thereon. The lowermost edge is thus not always fully in engagement with the roadway surface over its entire length, so some materials tend to remain on the roadway surface at various locations, especially where the surface height is the lowest compared to the immediate surrounding areas. The efficiency of the cleaning is thus reduced.

Road maintenance operators must often use de-icing chemicals after removing snow and ice with a blade to melt the remaining frozen water materials to complete the cleaning. The quantities of de-icing chemicals are generally inversely proportional to the efficiency of the cleaning. Thus, if the cleaning can be more efficient, less de-icing chemicals would be required. Using fewer de-icing chemicals can lower the operating costs and decrease the footprint on the environment, among other things.

Many snowplow blades are relatively large in width to maximize the size of the area that can be cleaned in a single pass. However, they are instances where road maintenance operators must also clean areas where only snowplow blades that are relatively narrow in width can fit. Having the ability of changing the width of the blades is desirable to improve the versatility of the equipment and some arrangements where the width of the blade can be adjusted in operation have been suggested in the past. Some width-adjustable blades can be larger than one car lane when fully extended. However, on most roadway surfaces, the benefits of increasing the width of a conventional snowplow blade to a very large size are generally offset by the decrease of the efficiency of the cleaning since the likelihood of height variations along the blade width increases.

Existing arrangements for width-adjustable blades also tend to be complex to manufacture and to maintain, among other things, thereby adding other difficulties for manufacturers and road maintenance operators. These difficulties, when added to the decrease in efficiency when increasing the width of conventional snowplow blade, are detrimental to a widespread use of width-adjustable blades. Road maintenance equipment, in particular the ones designed for operating on highways, currently use other arrangements such as lateral wing blades to further increase the width that can be cleaned in a single pass. Some vehicles can include a lateral wing blade on each side and each of them can be remotely lowered by their operators when needed. One drawback, however, is that they often increase the overall width of the vehicle even when they are in a stowed position and this will then prevent the vehicle from operating or even from traveling wherever this increased width is smaller.

Overall, there is clearly room for further improvements to overcome at least some of the challenges in this area of technology.

SUMMARY

The present concept involves a scraper blade device having an adjustable width and that also includes one or more sets of juxtaposed blade segments at the bottom. The bottom edges of these blade segments can be tilted of a few degrees with reference to one another, thereby allowing the scraper blade device to better follow the irregularities encountered on the roadway surface as the scraper blade device moves thereon.

In one aspect, there is provided a width-adjustable scraper blade device for cleaning a roadway surface, the scraper blade device having a lowermost edge, the scraper blade device including: a main transversal support; and an elongated moldboard generally extending along a transversal axis, the moldboard including two partially overlapping elongated moldboard units, one being on a right side and another one being on a left side of the moldboard, the moldboard units being slidably mounted to one another and one of the moldboard units being slidably mounted to a front side of the main transversal support, the moldboard units being movable with reference to one another at least between an extended position and a collapsed position, each moldboard unit including an upper section and a bottom section, the bottom section including a plurality of width-wise-disposed and juxtaposed blade segments, each blade segment including a bottom surface-engaging edge and the bottom surface-engaging edges of the blade segments of the two moldboard sections forming together the lowermost edge of the scraper blade device, each blade segment being operatively connected to the upper section and the bottom surface-engaging edges of the blade segments being tiltable with reference to one another to follow profile variations of the roadway surface.

In one aspect, there is provided a width-adjustable scraper blade device for cleaning a roadway surface, the scraper blade device having a lowermost edge, the scraper blade device including: a main transversal support; an elongated moldboard generally extending along a transversal axis, the moldboard including two partially overlapping elongated moldboard units, one being on a right side and another one being on a left side of the moldboard, the moldboard units being slidably mounted to one another and one of the moldboard units being slidably mounted to a front side of the main transversal support, the moldboard units being movable with reference to one another at least between an extended position and a collapsed position, each moldboard unit including: an upper section and a bottom section, the bottom section including a plurality of widthwise-disposed and juxtaposed blade segments, each blade segment including a bottom surface-engaging edge and the bottom surface-engaging edges of the blade segments of the two moldboard sections forming together the lowermost edge of the scraper blade device, each blade segment being operatively connected to the upper section and the bottom surface-engaging edges of the blade segments being tiltable with reference to one another to follow profile variations of the roadway surface; a plurality of spaced-apart force-generating mechanisms mounted between the upper section and the bottom section to exert return forces urging the blade segments downward; a right wing unit pivotally connected to an outer end of the right moldboard unit; a left wing unit pivotally connected to an outer end of the left moldboard unit; a first actuator mounted between the main transversal support and the right moldboard unit; a second actuator mounted between the main transversal support and the left moldboard unit; a third actuator mounted between the right wing unit and the right moldboard unit; and a fourth actuator mounted between the left wing unit and the left moldboard unit.

In another aspect, there is provided a scraper blade device as shown, described and/or suggested herein.

In another aspect, there is provided a method of cleaning a surface as shown, described and/or suggested herein.

Details on various aspects and features of the proposed concept will become apparent in light of the detailed description which follows and the appended figures.

DETAILED DESCRIPTION

Figure 1:
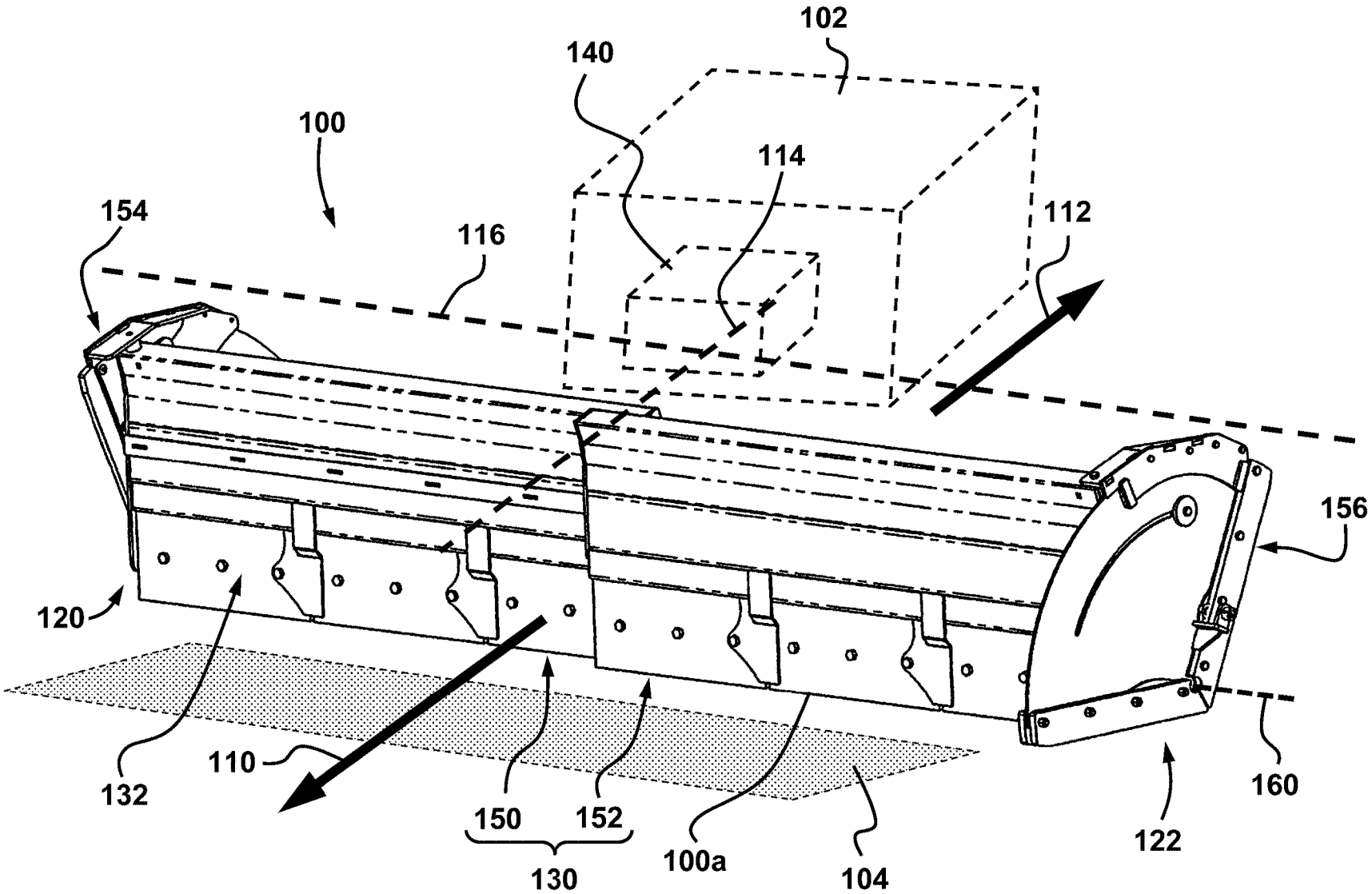
FIG. 1 is an isometric semi-schematic front view of an example of a scraper blade device according to the proposed concept.

FIG. 1 is an isometric semi-schematic front view of an example of a scraper blade device 100 according to the proposed concept. This scraper blade device 100 is adapted to be mounted to a host vehicle, for example a truck, a tractor or any other suitable type of vehicle. The vehicle is schematically depicted in FIG. 1 at 102. Depending on the implementation, the scraper blade device 100 can be located at the front or at the rear of the vehicle 102 with reference to the normal traveling direction of the vehicle 102. Other configurations and arrangements are possible. For instance, the scraper blade device 100 could be provided under the vehicle 102 or even elsewhere in some implementations. One can also clean a surface with the scraper blade device 100 without necessarily mounting it to a vehicle since the scraper blade device 100 could be used in many other applications. One example of another application is to clean the surface of a conveyor belt transporting one or more materials. Other variants are also possible as well.

The illustrated scraper blade device 100 is primarily designed to clean a roadway surface, for example to clear or otherwise remove frozen water materials from the roadway surface. The roadway surface is schematically depicted in FIG. 1 at 104. One can also use the scraper blade device 100 for removing other kinds of loose or adhering materials on a given surface to be cleaned. Examples of materials include earth, mud, gravel, stones, sand and waste, to name just a few. For the sake of simplicity, the present description occasionally refers to frozen water materials, but it must be understood that the proposed concept is not necessarily limited to such materials.

Furthermore, the exact overall shape and configuration of the scraper blade device 100 are not limited to the example as described and shown. The design can vary from one implementation to another. The illustrated scraper blade device 100 is configured for cleaning the roadway surface 104 at a relatively slow speed, such as for cleaning parking lots or roads in residential areas. A scraper blade device for cleaning highways or the like would generally be shaped with a curved upper portion. Other variants are possible as well.

It should also be noted that the term roadway surface is used herein in a generic sense and generally refers to any surface that can be cleaned using a scraper blade device. The roadway surface 104 may be the upper surface of a street or road, but it can also be, for instance, a sidewalk, a parking lot, a pedestrian crossing, a commercial or residential driveway, a bicycle path, an airport runway, a frozen lake, etc. The roadway surface 104 could even be a surface that is not outdoors or be an unpaved surface. In the latter case, the unpaved surface on which travels the vehicle 102 carrying the scraper blade device 100 constitutes the roadway surface. Other variants and implementations are also possible.

Figure 2:
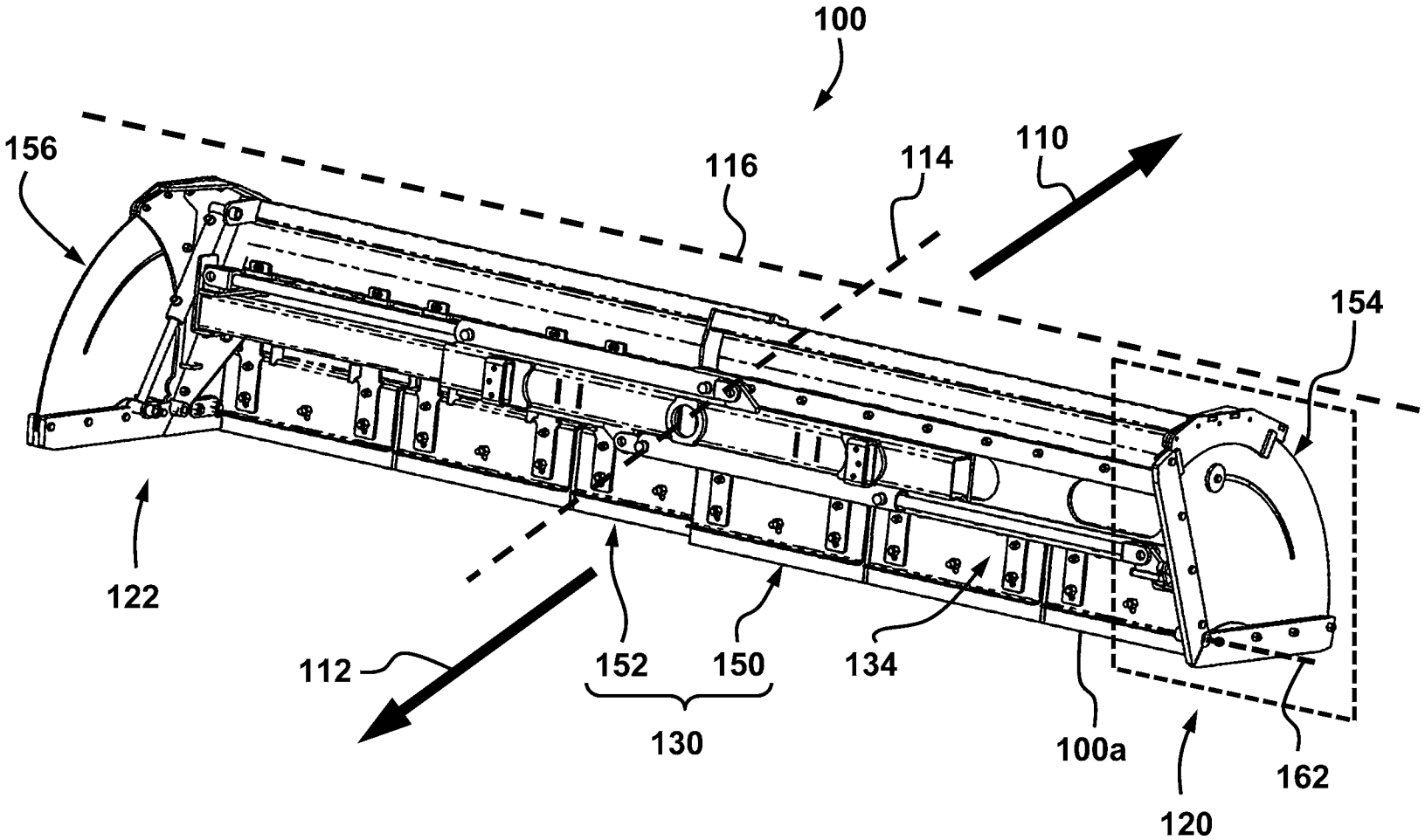
FIG. 2 is an isometric rear view of the scraper blade device in FIG. 1.

FIG. 2 is an isometric rear view of the scraper blade device 100 in FIG. 1. It thus shows the rear side thereof.

In FIGS. 1 and 2, arrow 110 depicts the forward travel direction of the scraper blade device 100 and arrow 112 depicts the rearward travel direction thereof. The forward and rearward travel directions 110, 112 correspond to the direction of the relative displacement of the scraper blade device 100 with reference to the roadway surface 104. The path followed by the scraper blade device 100 can be straight, curved or both, depending for instance on the trajectory of the vehicle 102. Hence, the forward and rearward travel directions 110, 112 correspond to the general direction of the relative displacement of the scraper blade device 100 with reference to the roadway surface 104 at a given instant.

The scraper blade device 100 can also have a central longitudinal axis 114 and a transversal axis 116 that is orthogonal to the longitudinal axis 114, as shown. The transversal axis 116 essentially defines the right-left direction of the scraper blade device 100. The scraper blade device 100 has a right end 120 and a left end 122.

The forward and rearward travel directions 110, 112 of the illustrated scraper blade device 100 will correspond to the forward and rearward directions of the vehicle 102, respectively, when the scraper blade device 100 is positioned at the front of the vehicle 102. However, the forward and rearward travel directions 110, 112 of the illustrated scraper blade device 100 will correspond to the rearward and forward directions of the vehicle 102, respectively, when the scraper blade device 100 is positioned at the rear of the vehicle 102.

The scraper blade device 100 can include an elongated moldboard 130 generally extending along the transversal axis 116, as shown. This moldboard 130 has a front plow surface 132 (FIG. 1) and a rear plow surface 134 (FIG. 2), the front plow surface 132 facing the forward travel direction 110 and the rear plow surface 134 facing the rearward travel direction 112. This scraper blade device 100 is bidirectional since it can clean the roadway surface 104 regardless of the travel direction. Other configurations and arrangements are possible as well.

The scraper blade device 100 can be mounted to the vehicle 102 using, for instance, a coupling assembly that can be part of the vehicle 102 itself or be a complementary mechanism added to the vehicle 102. The coupling assembly is schematically depicted in FIG. 1 at 140. The coupling assembly 140 attaches the moldboard 130 to the vehicle 102. It can include a carriage and one or more actuators, for instance hydraulic actuators, for lifting and lowering the lowermost edge 100*a* of the scraper blade device 100 with reference to the roadway surface 104. The scraper blade device 100 can be removably attached to the coupling assembly 140 using a corresponding mechanical attachment. Other configurations and arrangements are also possible.

The coupling assembly 140 can be designed to control or otherwise modulate the contact pressure between the lowermost edge 100*a* and the roadway surface 104 by supporting or not a part of the weight of the scraper blade device 100 in use. The coupling assembly 140 can also be designed to change the orientation of the scraper blade device 100 by pivoting it, for instance, around a generally vertical axis. The orientation angle can be controlled using one or more actuators, such as hydraulic actuators. Other arrangements and configurations are possible. For instance, the scraper blade device 100 can have an invariable position or orientation in some implementations. Using other kinds of actuators is possible. Other variants are possible as well.

Some implementations can include skids or even wheels that are provided underneath the ends 120, 122 of the scraper blade device 100, underneath the coupling assembly 140, or both. These skids or wheels can engage the roadway surface 104 to support at least a part of the weight of the scraper blade device 100 during operations, for instance to prevent some of the parts from directly engaging the roadway surface 104, thereby preventing these parts from wearing or be otherwise damaged. Other arrangements and configurations are possible as well. These features can also be omitted in some implementations.

Removing materials from the roadway surface 104 is generally done when the scraper blade device 100 has its lowermost edge 100*a* in engagement with the roadway surface 104 and the vehicle 102 moves thereon. In some implementations, the materials can simply accumulate on the front or rear plow surface 132, 134 and be pushed over some distance until the vehicle 102 stops and then moves in the opposite direction to leave these materials where they are now. In others, some materials can be discharged at one or both ends 120, 122 of the scraper blade device 100 as the vehicle 102 moves. Other configurations and arrangements are possible.

The moldboard 130 of the illustrated scraper blade device 100 includes two complementary moldboard units, namely a right moldboard unit 150 and a left moldboard unit 152. These moldboard units 150, 152 are slidably connected to one another about the center of the moldboard 130 and have overlapping portions. They are substantially straight and oriented parallel to the transversal axis 116 in the illustrated example, with the right moldboard unit 150 being slightly behind the left moldboard unit 152. The configuration can be inverted in some implementations. Other configurations and arrangements are also possible.

The moldboard units 150, 152 are slidably engaged to one another along the transversal axis 116 to vary the width of the scraper blade device 100, thus the distance between the opposite right and left ends 120, 122 thereof. This allows the width of the scraper blade device 100 to change. The scraper blade device 100 can also include an actuator system to change the relative position of the moldboard units 150, 152 even if it engages the roadway surface 104 and pushes some materials. This actuator system can allow the operator to adjust the width of the scraper blade device 100 as required. The adjustments can be made, for instance, using a selector inside the cabin of the vehicle 102. Other configurations and arrangements are possible as well. Among other things, some implementations may not include an actuator system, and the width may be adjustable, for instance, only through a manual repositioning process when the vehicle 102 is parked. Other variants are possible as well.

The width of the illustrated scraper blade device 100 can vary from a minimum width to a maximum width. The minimum width corresponds to a collapsed position and the maximum width to an extended position. The operator can select either one of these end positions or can also select an intermediary position. FIG. 1 shows the scraper blade device 100 in an extended position.

Figure 13:
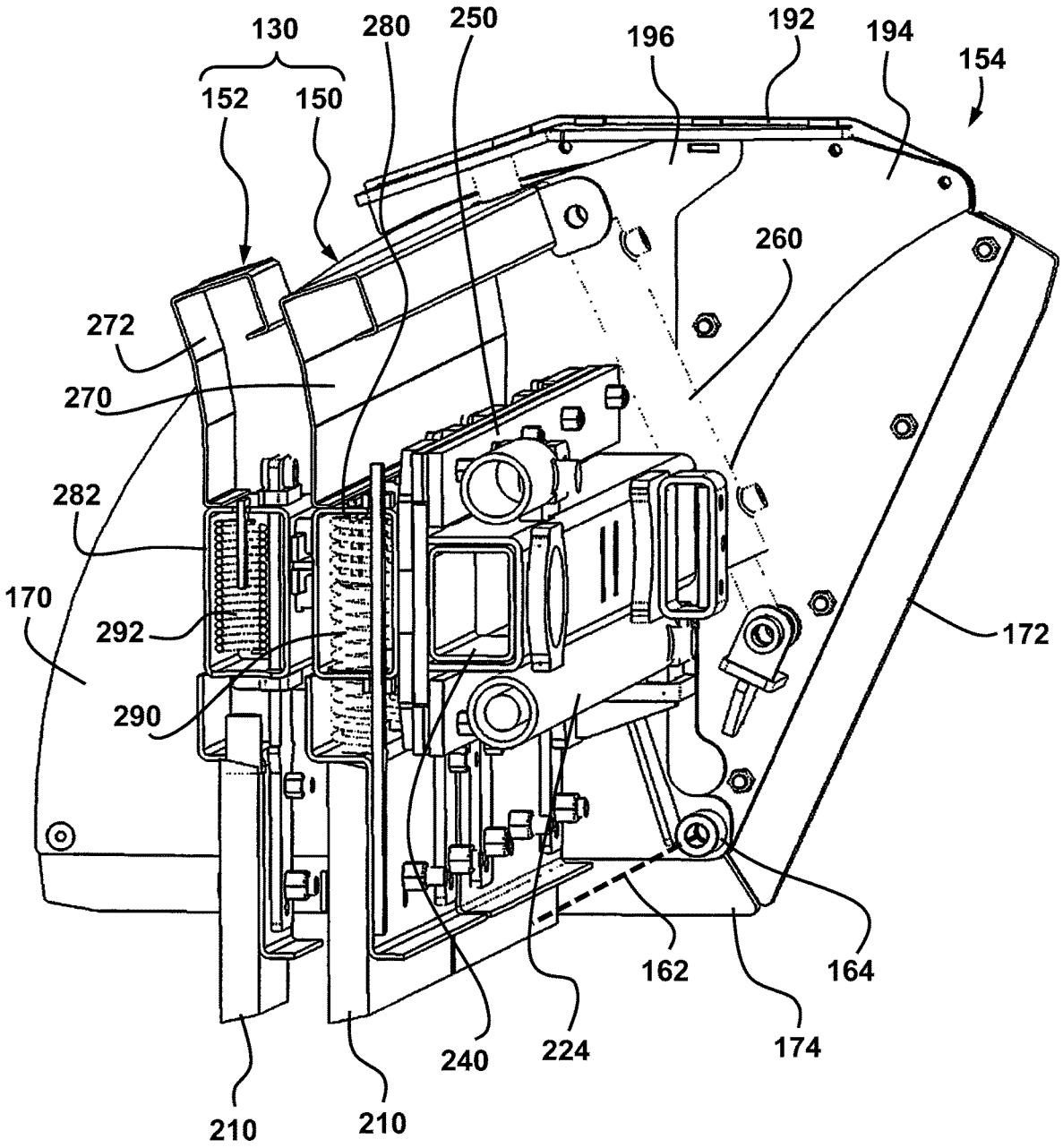
FIG. 13 is an isometric cross-section view of the scraper blade device taken approximately at the center thereof.
Figure 14:
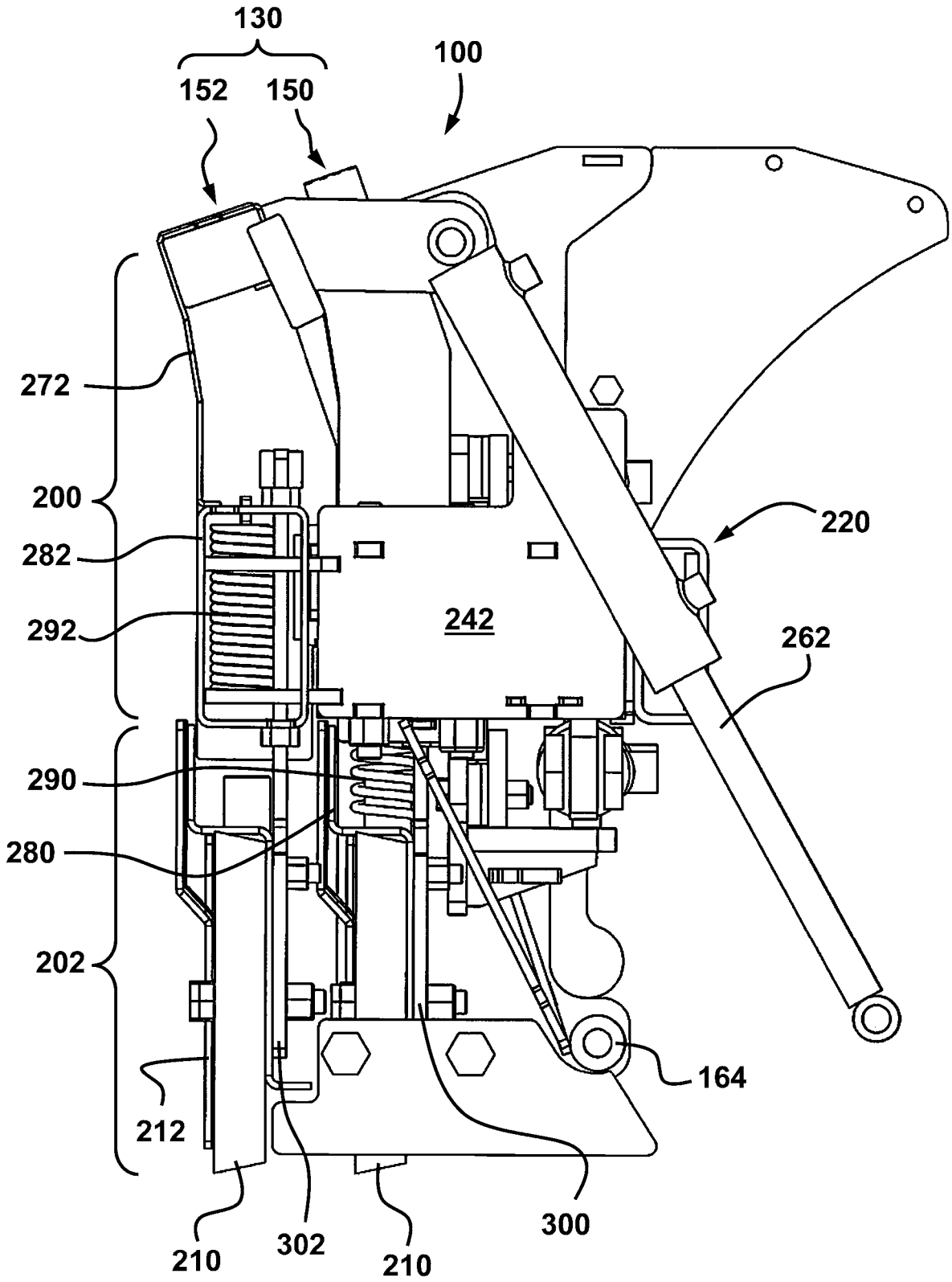
FIG. 14 is a cross-section view of the scraper blade device taken along line 14-14 in FIG. 12.
Figure 16:
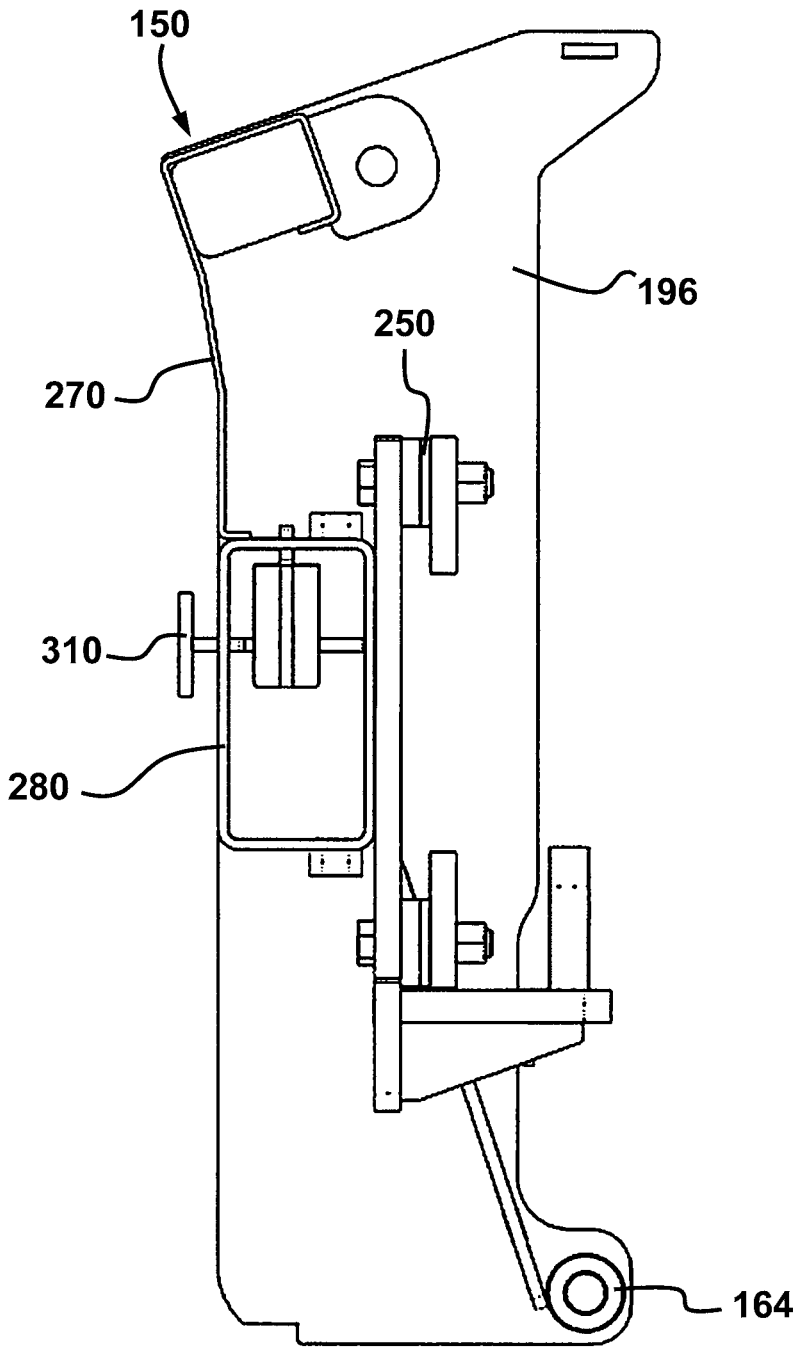
FIG. 16 is a partial left-end view of the right moldboard unit in FIG. 9.
Figure 17:
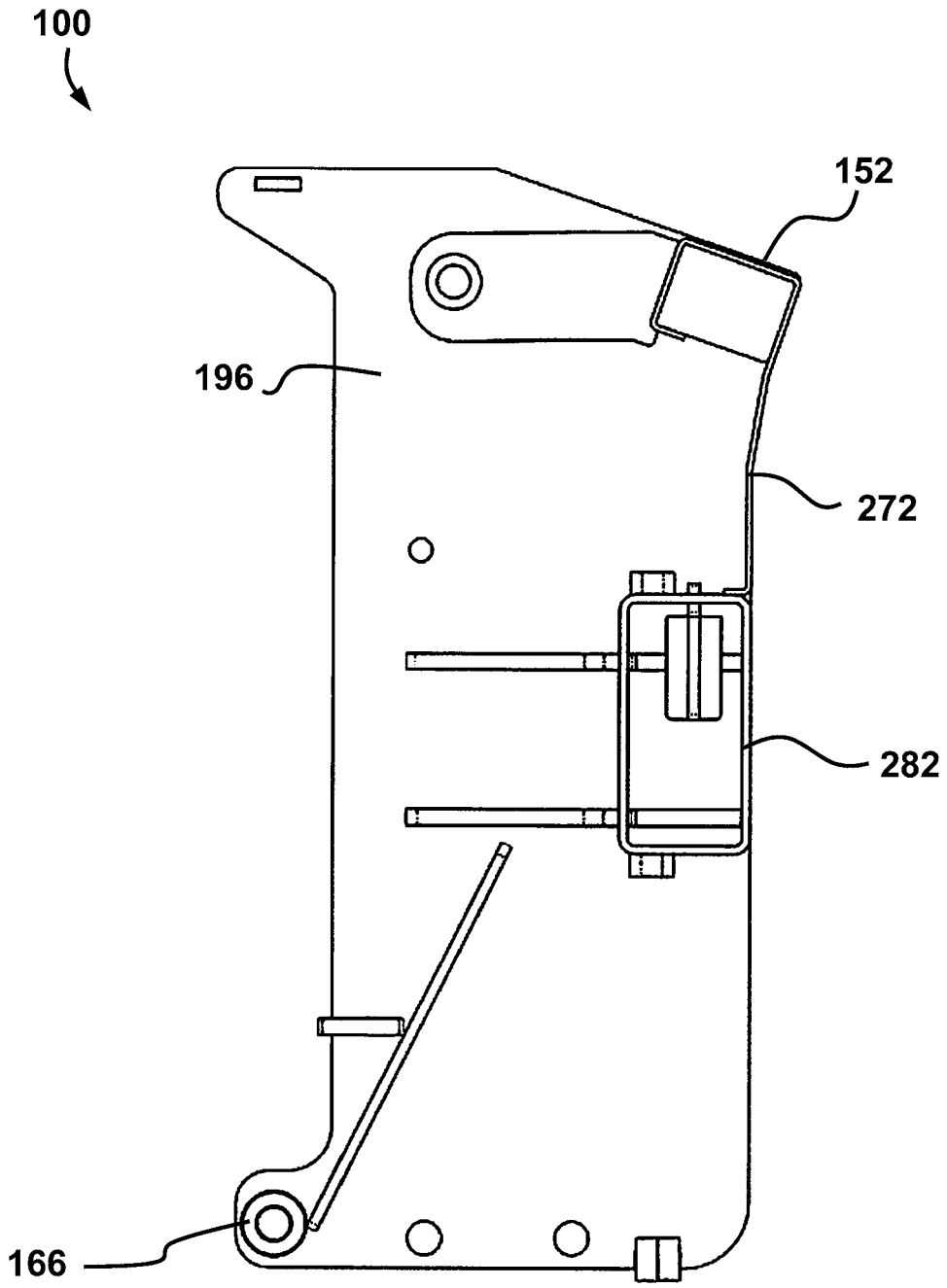
FIG. 17 is a partial right-end view of the left moldboard unit in FIG. 9.

The scraper blade device 100 can include two wing units 154, 156, as shown. In the illustrated example, one is a right wing unit 154 located at the right end 120, the other being a left wing unit 156 located at the left end 122. These wing units 154, 156 can be oriented substantially parallel to the longitudinal axis 114. The right wing unit 154 can pivot around a first pivot axis 160 (FIG. 2) and the left wing unit 156 can pivot around a second pivot axis 162 (FIG. 1). These pivot axes 160, 162 can be substantially parallel to the transversal axis 116, as shown in the illustrated example. The pivots connecting the wing units 154, 156 to the corresponding ends of the moldboard units 150, 152 can include bearings, axles, etc. The right pivot is depicted in FIGS. 13, 14 and 16 at 164, and the left pivot is depicted in FIG. 17 at 166. The position of each wing unit 154, 156 can be shifted from the front to the rear, and vice versa, using actuators. Details concerning the actuators of the illustrated example are given later. Other configurations and arrangements are possible. Among other things, the wing units 154, 156 can be constructed differently compared to what is shown and described. They can be stationary in some implementations and even be entirely omitted in others. Other variants are possible as well.

It should be noted that the angular positions of the right and left wing units 154, 156 are unidentical in FIG. 1 and also in FIG. 2. This is only for the sake of illustration.

The wing units 154, 156 can allow the accumulation of a relatively large quantity of materials in front of the scraper blade device 100 and to push these materials up to a given location. Pivoting the right wing unit 154 towards the rear can be useful if the operator wants to minimize the quantity of materials accumulating on the front plow surface 132 near at the right end 120 when the scraper blade device 100 moves in the forward travel direction 110, or wants to maximize the quantity of materials accumulating on the rear plow surface 134 near the right end 120 when the scraper blade device 100 moves in the rearward travel direction 112. Likewise, pivoting the left wing unit 156 towards the front, as shown in FIGS. 1 and 2, can be useful if the operator wants to maximize the quantity of materials accumulating on the front plow surface 132 near at the left end 122 when the scraper blade device 100 moves in the forward travel direction 110, or wants to minimize the quantity of materials accumulating on the rear plow surface 134 near the left end 122 when the scraper blade device 100 moves in the rearward travel direction 112. The different possible settings give many options to the operator for handling materials.

Figure 3:
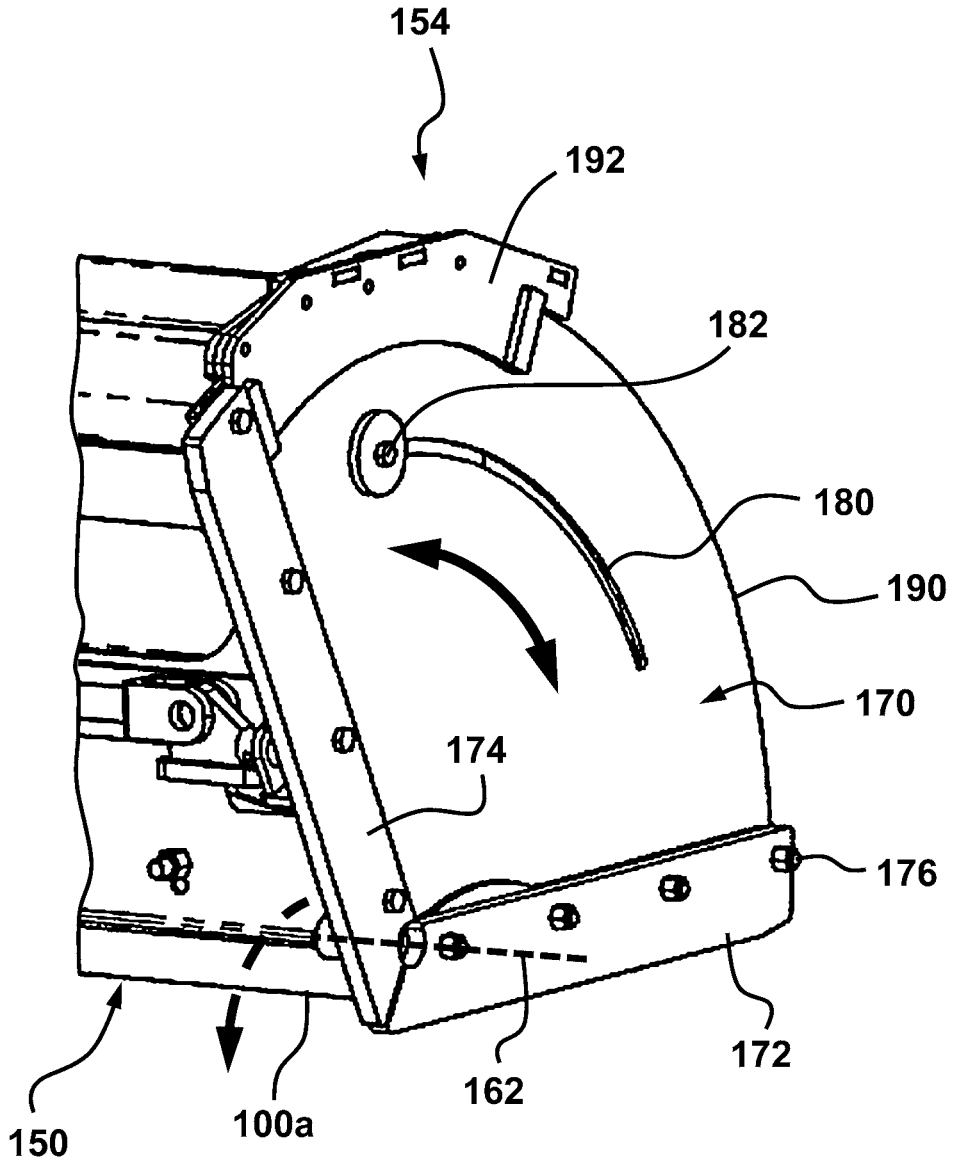
FIG. 3 is an enlarged view of the area delimited by a stippled line at the right end of the scraper blade device in FIG. 2.

Each of the wing units 154, 156 can include a rigid panel 170 that has a relatively flat shape and oriented substantially parallel to the longitudinal axis 114, as shown in the illustrated example. FIG. 3 is an enlarged view of the area delimited by a stippled line at the right end 120 of the scraper blade device 100 in FIG. 2. Other configurations and arrangements are possible.

Furthermore, each wing unit 154, 156 can include two juxtaposed skid members 172, 174, as shown in FIG. 3. In the illustrated example, the skid members 172, 174 can have adjoining ends near the corresponding one of the pivot axes, for instance the first pivot axis 160 as shown in FIG. 3. The left end 122 of this scraper blade device 100 has a similar configuration with respect to the pivot second axis 162. Each skid member 172, 174 can include one or more strips of a low-friction material and multiple strips of a same skid member can be parallel to one another, as shown in the illustrated example. The strips can be rectilinear, but variants are possible. The skid members 172, 174 can be made easily removable, for instance using bolts or other similar fasteners 176, to facilitate their replacement if they are damaged or worn. These strips are somewhat sacrificial parts and can prevent other components from being damaged in case of an accidental or inadvertent impact with a structure like a curb or a wall. On each side, the bottom edge of the skid member 172 engages the roadway surface 104 when the corresponding one of the wing units 154, 156 is oriented towards the front and the bottom edge of the opposite skid member 174 engages the roadway surface 104 when it is oriented towards rear. Other configurations and arrangements are possible. Among other things, the skids can be designed differently or even be omitted in some implementations. Other variants are possible as well.

If desired, the pivot motion of each wing unit 154, 156 can be less than 90 degrees and the relative angle between the two skid members 172, 174 can be more than 90 degrees, as shown.

The panel 170 can include an arcuate slot 180 receiving a corresponding follower 182, the slot 180 being substantially coaxial with the corresponding pivot axis. This can be seen in the example shown in FIG. 3. The slot 180 is made through the panel 170, and it is substantially coaxial with the first pivot axis 160. The inner end of the follower 182 can be rigidly connected to the right moldboard unit 150. The follower 182 abuts against the opposite ends of the slot 180 in the end positions of the right wing unit 154. A similar arrangement is provided at the left. Other configurations and arrangements are possible. These features can also be omitted in some implementations.

Likewise, the panel 170 can include an arc-shaped edge that is opposite to and substantially coaxial with the corresponding pivot axis. In the illustrated example, as shown in FIG. 3, the panel 170 includes an arc-shaped edge 190 that is substantially coaxial with the first pivot axis 160. The arc-shaped edge 190 can also pass inside a corresponding guide formed by an elongated outer member 192 that is rigidly connected at the top edge of a relatively large lateral plate 194 (FIG. 13) forming the outer end of the right moldboard unit 150. The lateral plate 194 extends substantially parallel to the longitudinal axis 114 in the illustrated example, and the panel 170 of the corresponding right wing unit 154 is positioned next to the outer side of the lateral plate 194. The panel 170 remains parallel to the lateral plate 194. The outer member 192 is only connected to the lateral plate 194 along their top edges, and the rest of the inner surface of the outer member 192 extends substantially parallel to the adjacent outer surface of the lateral plate 194. The intervening space between them is configured and disposed so that the panel 170 is free to pivot. However, this arrangement can act as a guide keeping the panel 170 in alignment with the lateral plate 194. The lateral plate 194 can be itself rigidly attached to the structural parts extending transversally along the right moldboard unit 150 using an inner plate 196 (FIG. 13). This inner plate 196 can be affixed to the inner surface of the lateral plate 194. A similar arrangement is provided at the left. Other configurations and arrangements are possible. Some of these features may also be omitted in some implementations.

Figure 4:
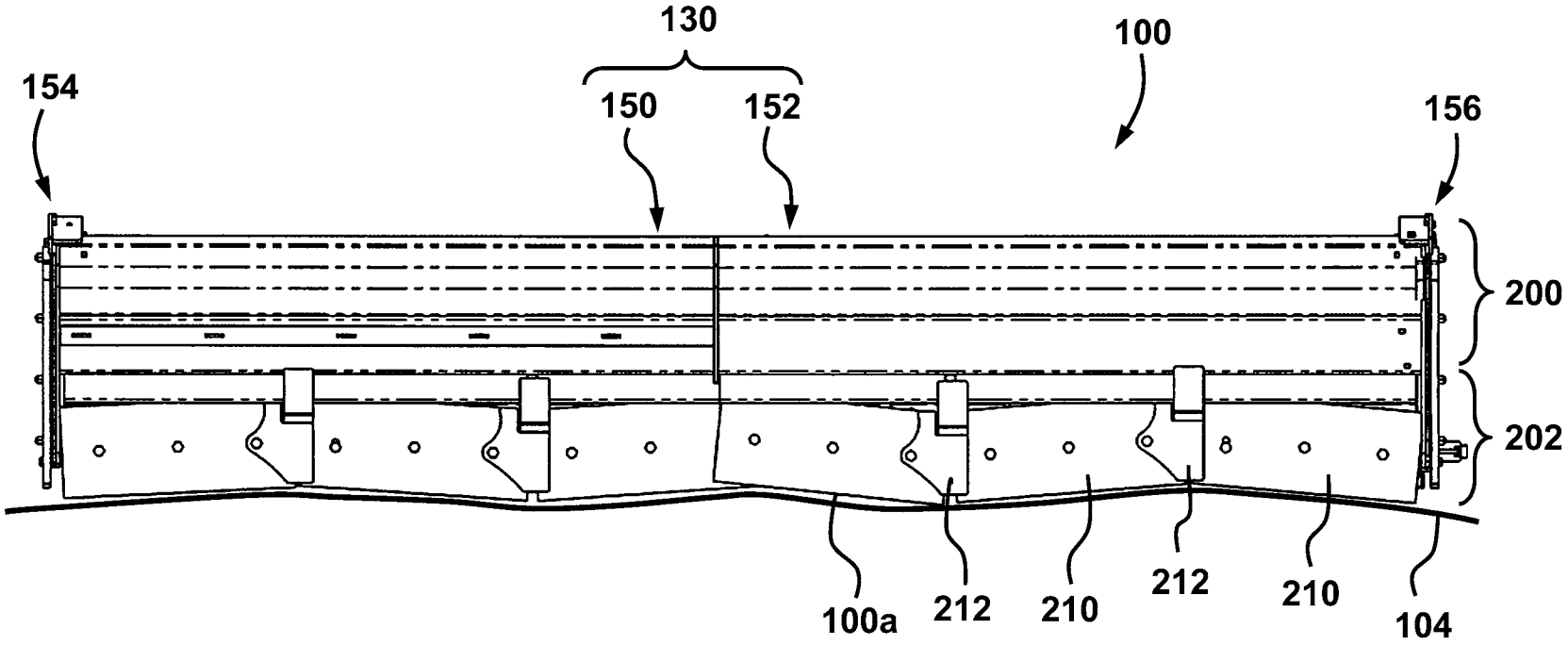
FIG. 4 is a front view of the scraper blade device in FIG. 1 engaging an example of a roadway surface.

FIG. 4 is a front view of the scraper blade device 100 shown in FIG. 1 engaging an example of a roadway surface 104.

Each moldboard unit 150, 152 can include a part of the upper section 200 and a bottom section 202. The bottom section 202 includes a plurality of widthwise-disposed and juxtaposed blade segments 210. The widthwise direction corresponds to the transversal axis 116. The blade segments 210 within each moldboard unit 150, 152 can be substantially parallel and coplanar, as shown in the illustrated example. The blade segments 210 are slidingly movable in an up and down movement. Each blade segment 210 can have a substantially rectangular shape. Nevertheless, in some implementations, other shapes, widths or both can be provided. The blade segments 210 can be made of different materials, for instances steel, stainless steel or a polymer, to name just a few. In some applications, some of the blade segments 210 can be made at least in part of a resilient material, such as rubber or the like, instead of an entirely rigid material. Other configurations, arrangements and materials are also possible. For instance, the blade segments could be configured as disclosed in U.S. Pat. No. 10,480,140 issued on 19 Nov. 2019 to Jimmy Vigneault. U.S. Pat. No. 10,480,140 is hereby incorporated by reference in its entirety. Other variants are also possible as well.

Each blade segment 210 includes a bottom surface-engaging edge that will slide on the roadway surface 104 when the scraper blade device 100 is lowered to a ground-engaging position and propelled by the vehicle 102. The bottom surface-engaging edges of the blade segments 210 of the two moldboard units 150, 152 form together the lowermost edge 100*a* of the scraper blade device 100. The blade segments 210 can tilt (i.e., to move out of horizontal alignment) with reference to one another. This way, the scraper blade device 100 can better follow the height variation profile of the roadway surface 104. The blade segments 210 remain otherwise essentially parallel and often coplanar with tilted with reference to one another. Other configurations and arrangements are possible.

The blade segments 210 can be guided by a pair of spaced-apart guiding arrangements on each blade segment 210. These guiding arrangements are not preventing the blade segments 210 from tilting. This can be achieved, for instance by loosely or pivotally mounting the blade segments 210 on the mechanical connector attaching them to the guiding arrangement. The connector is constrained into the up and down path but each blade segment 210 is capable of pivoting about its connector. Other configurations and arrangements are possible.

The blade segments 210 can be configured and disposed so as to provide a marginal spacing between them to prevent the adjacently disposed blade segments 210 from interfering with one another, at least within at least part of the range of angles. The shape of the complementary parts and the tolerances can be chosen so that the lateral side edges of the blade segments 210 can tilt with reference to one another over at least a few degrees in both directions. In some instances, the lateral side edges of two adjacent blade segments 210 may engage one another. Other configurations and arrangements are possible.

Figure 5:
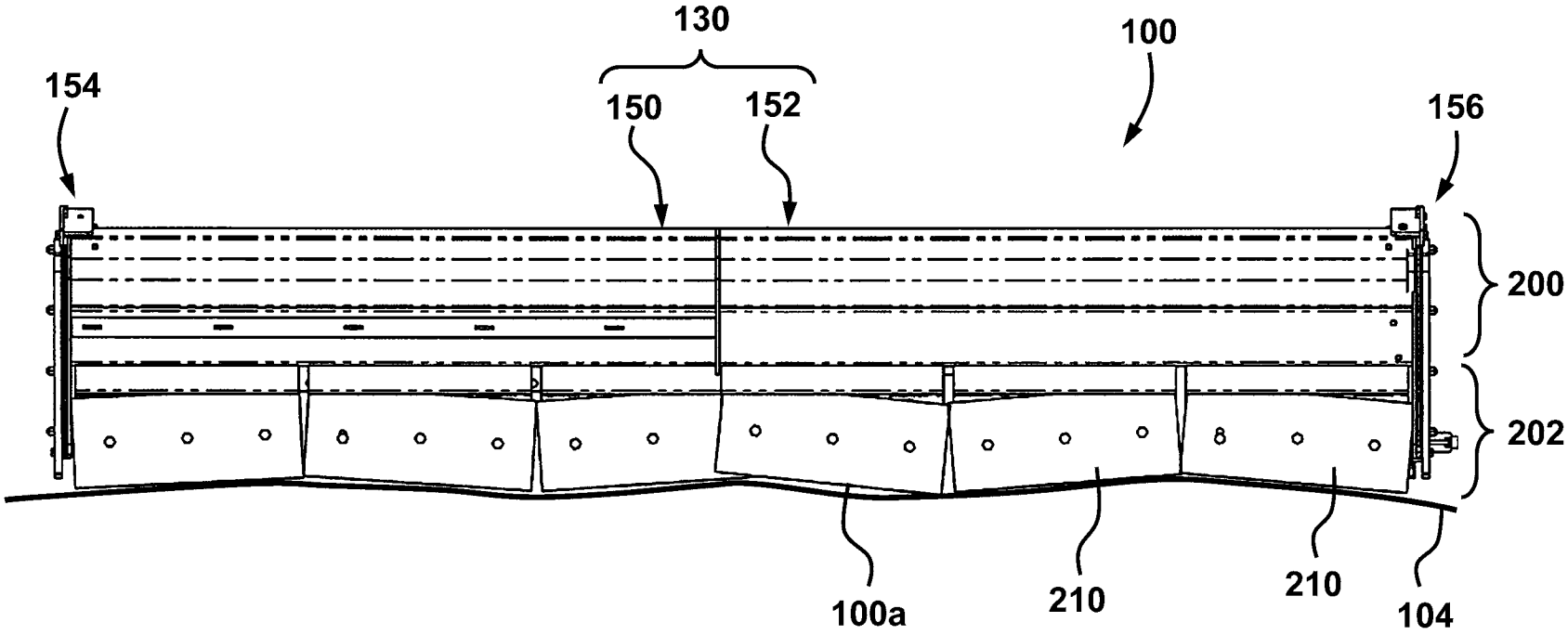
FIG. 5 is a view similar to FIG. 4 in which the cover plates were removed for the sake of illustration.

A cover plate 212 can be positioned and disposed to overlap the bottom gap between two adjacent blade segments 210, as shown in the illustrated example. Cover plates 212 can be seen in FIG. 4. FIG. 5 is a view similar to FIG. 4 in which the cover plates 212 were removed for the sake of illustration. The cover plates 212 close the gaps between the blade segments 210 so as to minimize the amount of materials that can eventually pass therein. It can also be useful to prevent material from accumulating inside the bottom gap under certain conditions and interfere with the normal pivot movements between the blade segments 210 in operation. Variants in the shape, the disposition and the configuration of the cover plates 212 are possible as well. Cover plates 212 can also be entirely omitted in some implementations.

The scraper blade device 100 is designed to react to a localized unevenness on the roadway surface 104, as shown for instance in FIGS. 4 and 5. As aforesaid, roadway surfaces are generally not always perfectly smooth, flat and free of obstructions. The height of the roadway surface 104 often varies irregularly in a transversal direction, thus from one end of the lowermost edge 100*a* of the scraper blade device 100 to the other, and also continuously as the scraper blade device 100 is pushed in the forward travel direction 110. In FIGS. 4 and 5, the profile of the roadway surface 104 is a continuous succession of irregular curves but the scraper blade device 100 is adapted to this wavy shape. This is done on a continuous basis when the scraper blade device 100 is pushed in the forward travel direction 110 on the roadway surface 104.

The up and down movement capability of the blade segments 210 can provide a way of keeping the scraper blade device 100 in an optimized contact with the roadway surface 104 in spite of the continuous height variations across its width. The waviness, the undulations, the buckled zones and all other usual non-abrupt defects or transitions on the roadway surface 104 that do not significantly interfere with (i.e., impede) the sliding movement of the lowermost edge 100*a* of the scraper blade device 100 thereon are referred to as "irregularities". The bottom edges can be tilted to create a lowermost edge 100*a* that is somewhat "articulated", namely that can more closely follow the shape of the roadway surface 104.

Figure 6:
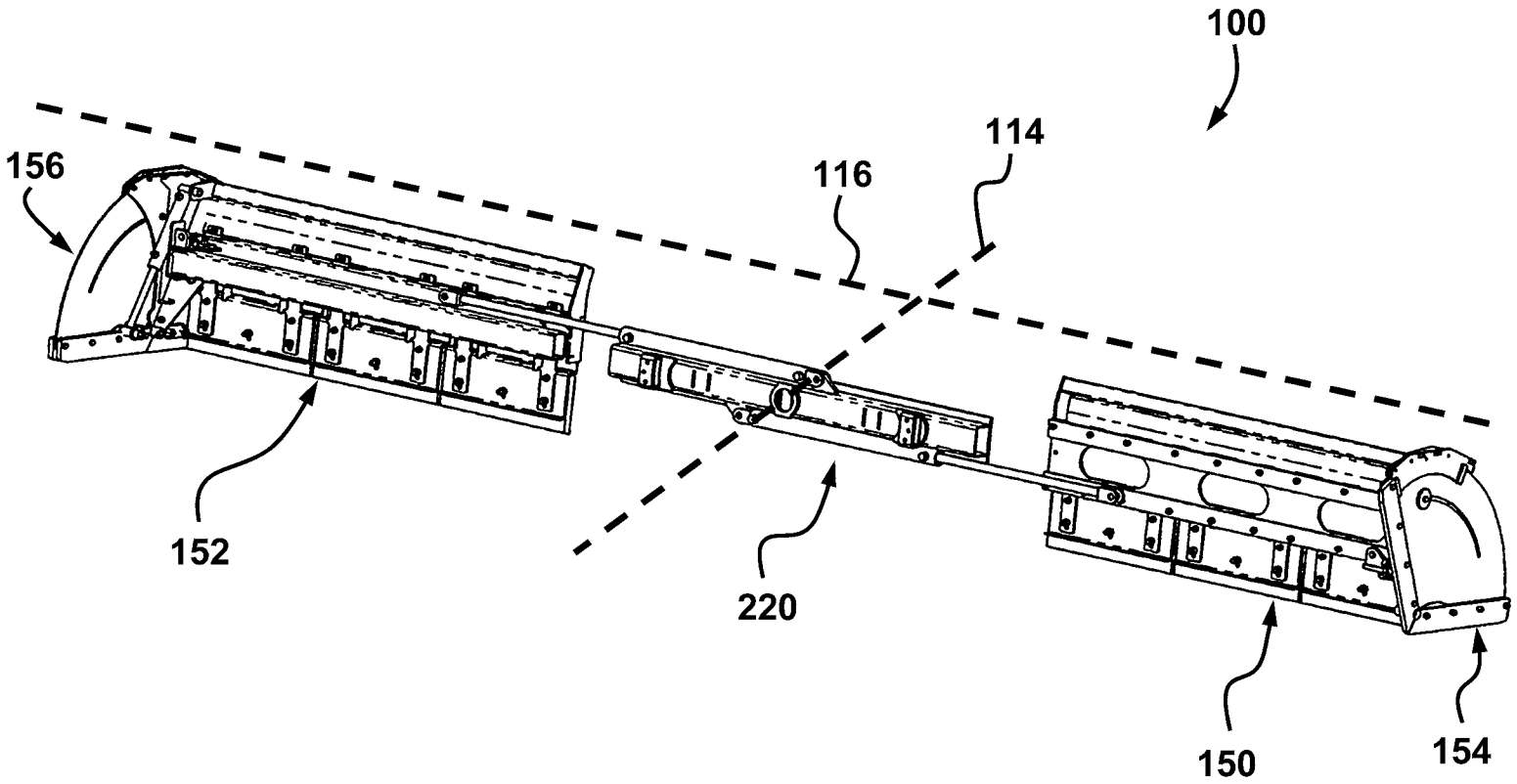
FIG. 6 is an exploded rear isometric view of the scraper blade device in FIG. 1.

FIG. 6 is an exploded rear isometric view of the scraper blade device 100 shown in FIG. 1. It shows both moldboard units 150, 152 being detached from one another. It also shows that the scraper blade device 100 can include a main transversal support 220 to which the moldboard units 150, 152 can be attached when the scraper blade device 100 is fully assembled. The moldboard units 150, 152 can slide independently from another with reference to the main transversal support 220. The main transversal support 220 is also the part where the coupling assembly 140 can be attached. Other configurations and arrangements are possible.

The main transversal support 220 can be located at the rear and can be centered with reference to the scraper blade device 100, as shown in the illustrated example. Other configurations and arrangements are possible.

Figure 7A:
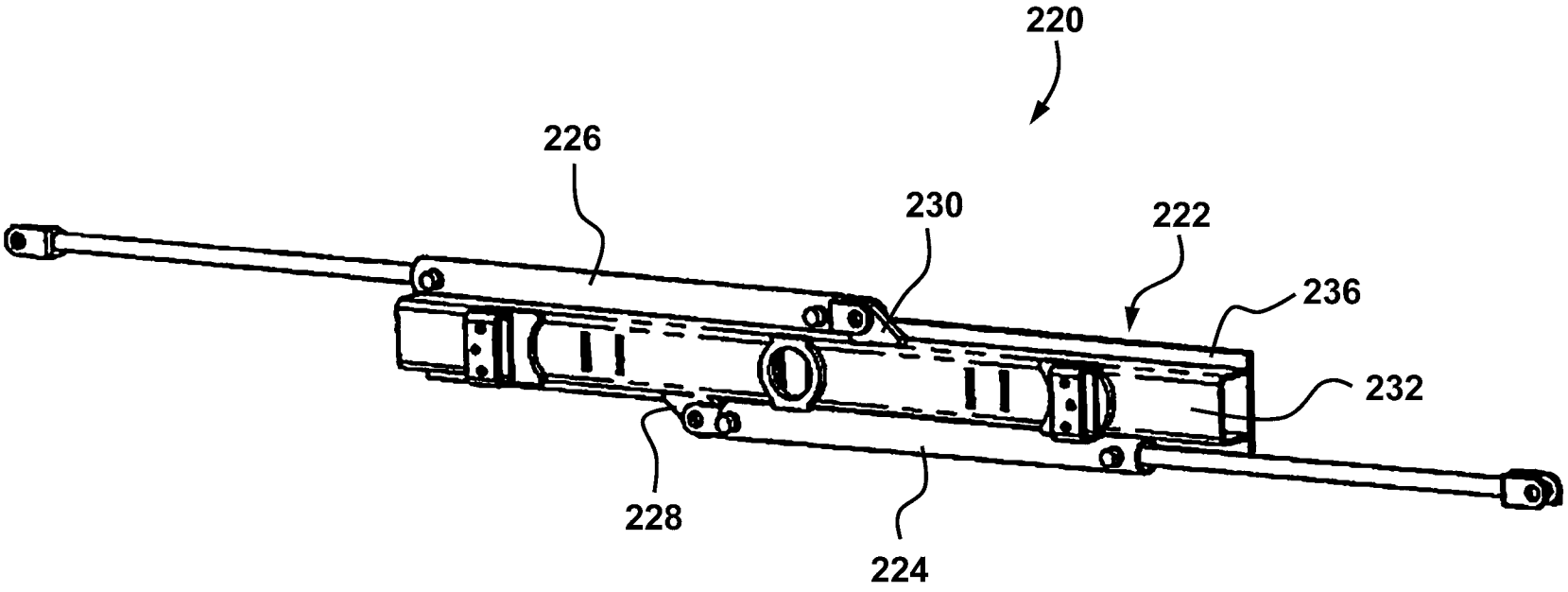
FIG. 7A is an enlarged view of the main transversal support shown in FIG. 6.

FIG. 7A is an enlarged view of the main transversal support 220 in FIG. 6. This main transversal support 220 can include a main elongated beam 222 that is rigid and rectilinear, as shown. It can also include a first actuator 224 extending transversally along a bottom end of the main elongated beam 222, and a second actuator 226 extending transversally along an upper end of the main elongated beam 222. These first and second actuators 224, 226 are opposite one another. The actuators 224, 226 can be hydraulic or pneumatic. Other kinds of actuators are also possible. As shown in the illustrated example, the first actuator 224 can have one end attached to a bottom flange 228 that is rigidly mounted to the rest of the main elongated beam 222, and an opposite end attached near the outer end on the rear side of the right moldboard unit 150. Likewise, the second actuator 226 can have one end attached to an upper flange 230 that is rigidly mounted to the rest of the main elongated beam 222, and an opposite end attached near the outer end on the rear side of the left moldboard unit 152. This configuration is implemented in the illustrated example and as a result, the first actuator 224 controls the position of the right moldboard unit 150 with reference to the main transversal support 220 and the second actuator 226 controls the position of the left moldboard unit 152 with reference to the main transversal support 220. Other configurations and arrangements are possible. For instance, the shapes and/or positions of the parts can be different from what is shown and described. Other variants are possible as well.

The main elongated beam 222 of the illustrated example has a body 232 defining a hollow rectangular inner space 234 that is open at least at the left end in this example. This space 234 is delimited on the front side by a front wall 236 having upper and bottom rectilinear edges extending beyond the other walls of the body 232. The front wall 236 is also thicker than the others. Again, other configurations and arrangements are possible. For instance, the shapes and/or positions of the parts can be different from what is shown and described. Other variants are possible as well.

Figure 7B:
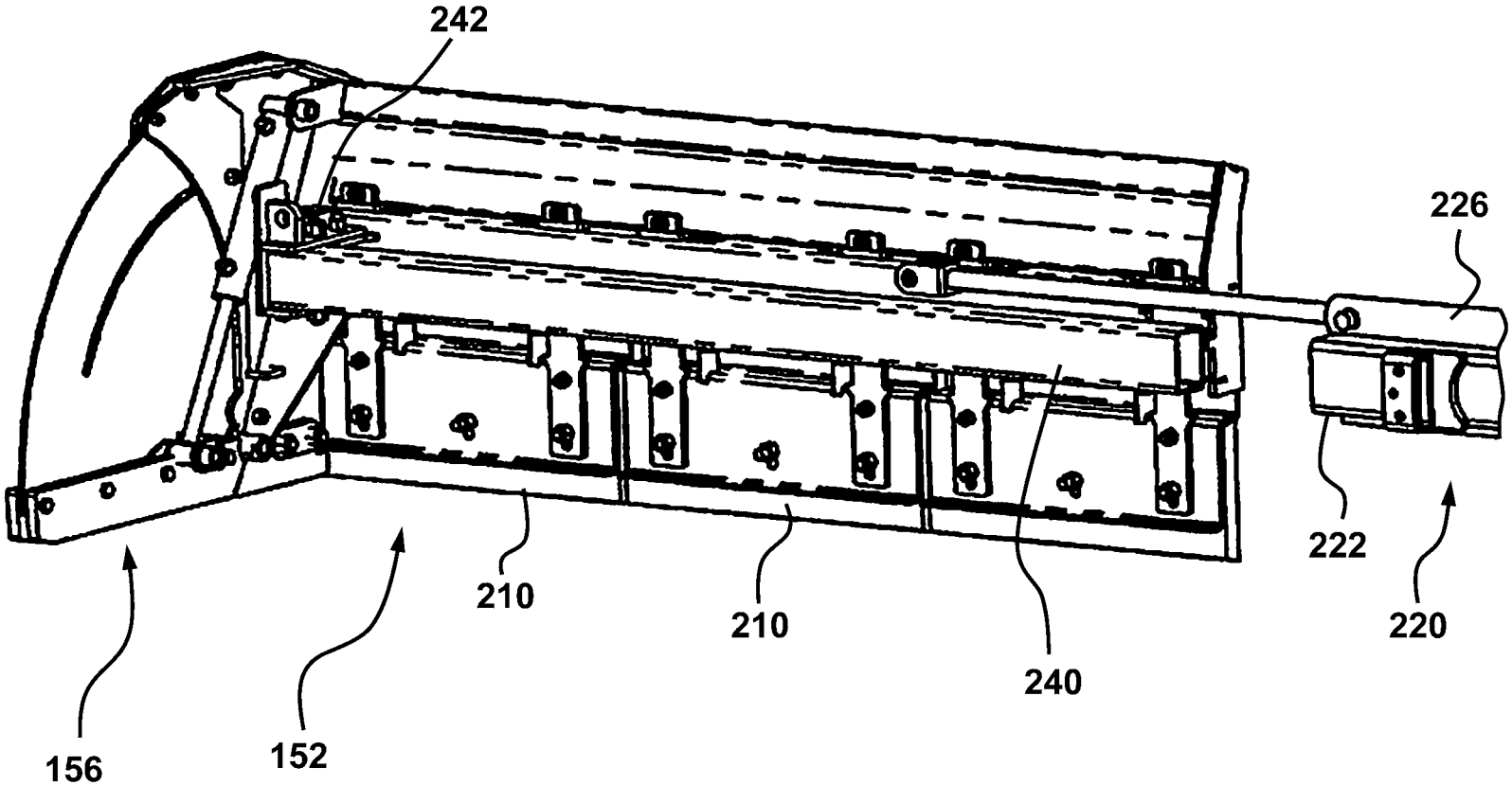
FIG. 7B is an enlarged view of the left moldboard unit shown in FIG. 6.

FIG. 7B is an enlarged view of the left moldboard unit 152 shown in FIG. 6. It also shows a small portion of the main transversal support 220. In the illustrated example, the left moldboard unit 152 includes a rear transversal cantilever beam 240 configured and disposed to fit in the space 234 of the main elongated beam 222 that is part of the main transversal support 220. The cantilever beam 240 is rigidly attached to the left moldboard unit 152 at a beam base 242 located next to the outer end of the left moldboard unit 152. The free end of the cantilever beam 240 can be inserted through the open end on the left side of the main elongated beam 222 and the whole cantilever beam 240 can slide inside the space 234 and acts as a guide. The parts are designed to fit relatively tightly, but the tolerances are still large enough to create a sliding engagement. Other configurations and arrangements are possible. The features can also be omitted in some implementations.

Figure 7C:
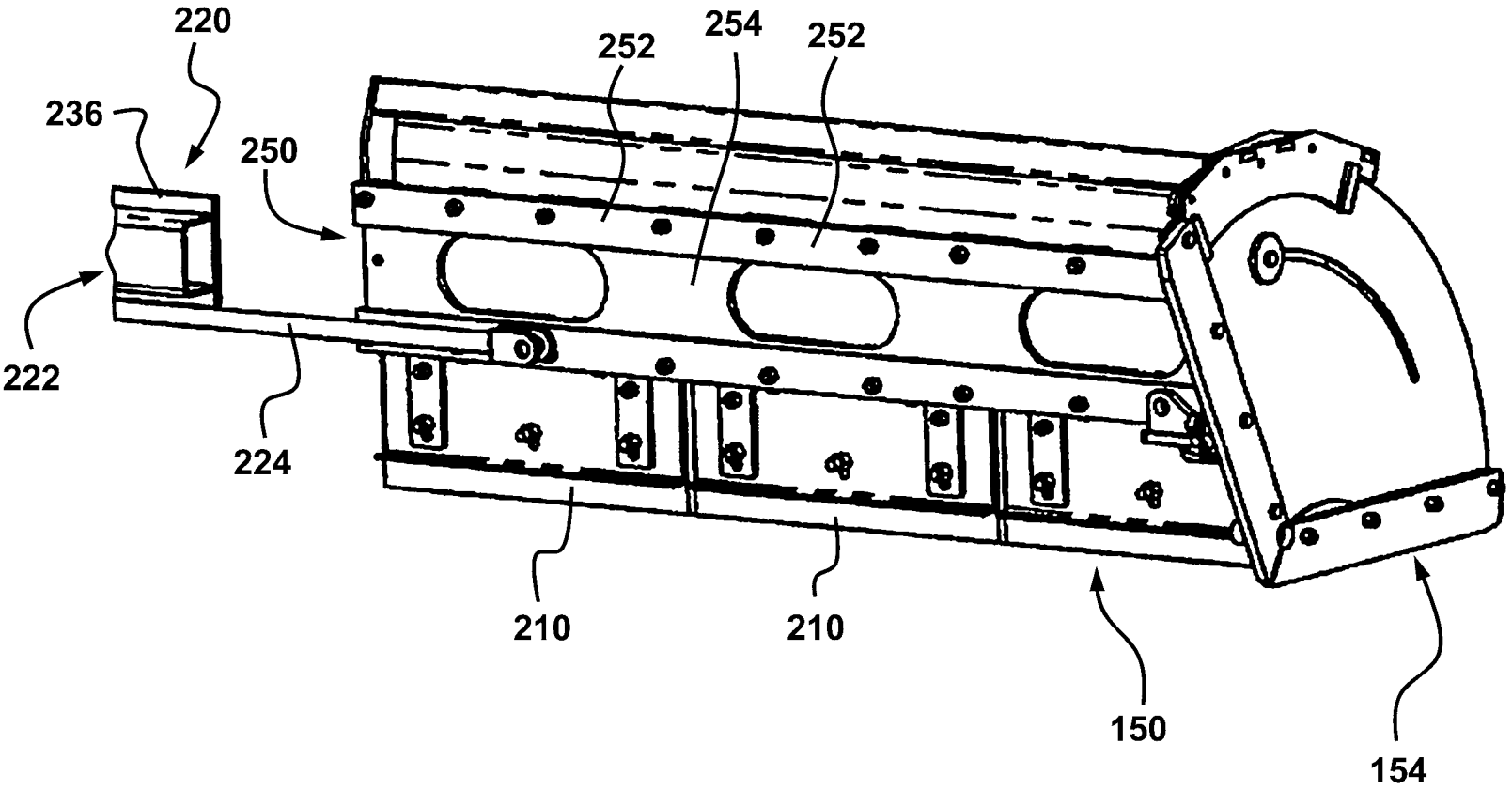
FIG. 7C is an enlarged view of the right moldboard unit shown in FIG. 6.

FIG. 7C is an enlarged view of the right moldboard unit 150 shown in FIG. 6. It also shows a small portion of the main transversal support 220. In the illustrated example, the right moldboard unit 150 is also guided by the main transversal support 220 but using the front wall 236. The upper and bottom edges extending from the front wall 236 are configured and disposed to engage a corresponding transversal track 250 provided at the rear of the right moldboard unit 150. These parts act as a guide. The track 250 is formed essentially by two spaced-apart rigid members 252 that are rigidly attached to the side of a larger transversal plate 254 but slightly away therefrom so as to leave an intervening space along the top and bottom edges of the plate 254 and form the track 250. The track 250 can receive the upper and bottom edges extending from the front wall 236. The parts can also be seen in FIG. 15. They are designed to fit relatively tightly, but the tolerances are still large enough to create a sliding engagement. Other configurations and arrangements are possible. The features can also be omitted in some implementations.

Figure 8:
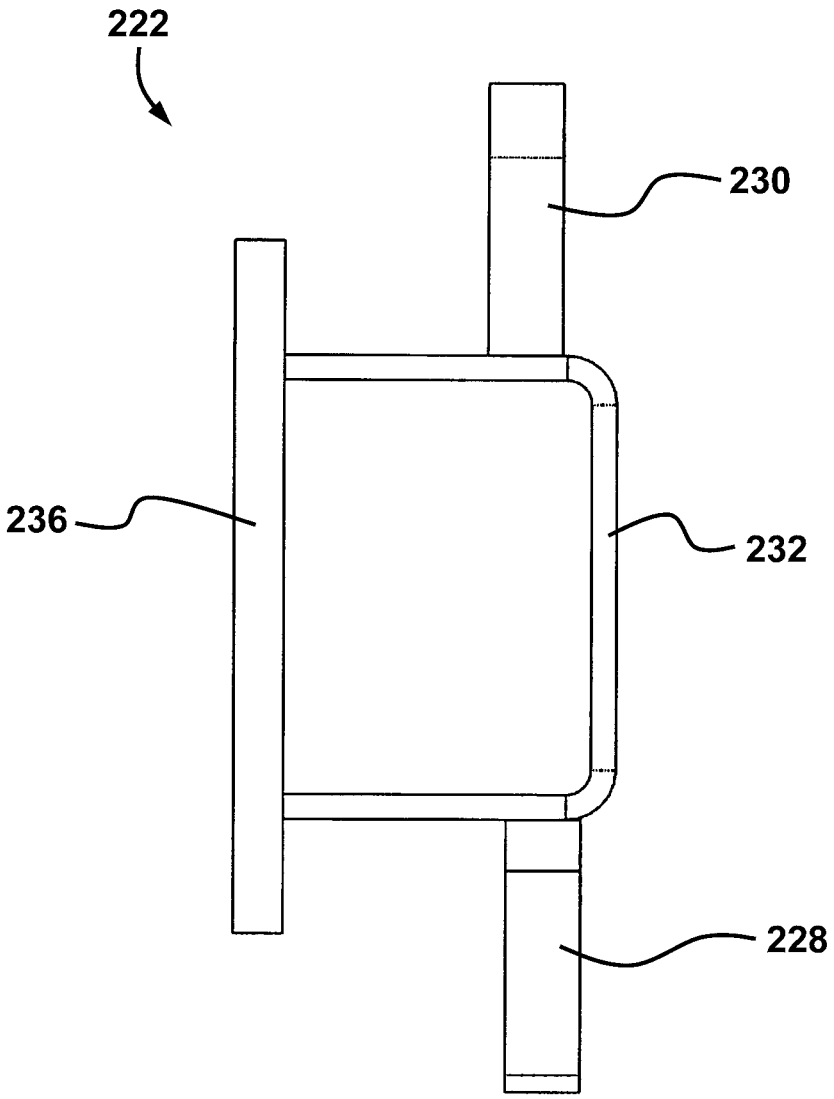
FIG. 8 is a left end view showing only the main elongated beam of the main transversal support in FIG. 7A.

FIG. 8 is a left end view showing only the main elongated beam 222 of the main transversal support 220. This main elongated beam 222 is part of the main transversal support 220 shown in FIG. 7A. The first and second actuators 224, 226 are thus not shown but the two flanges 228, 230 are visible.

Figure 9:
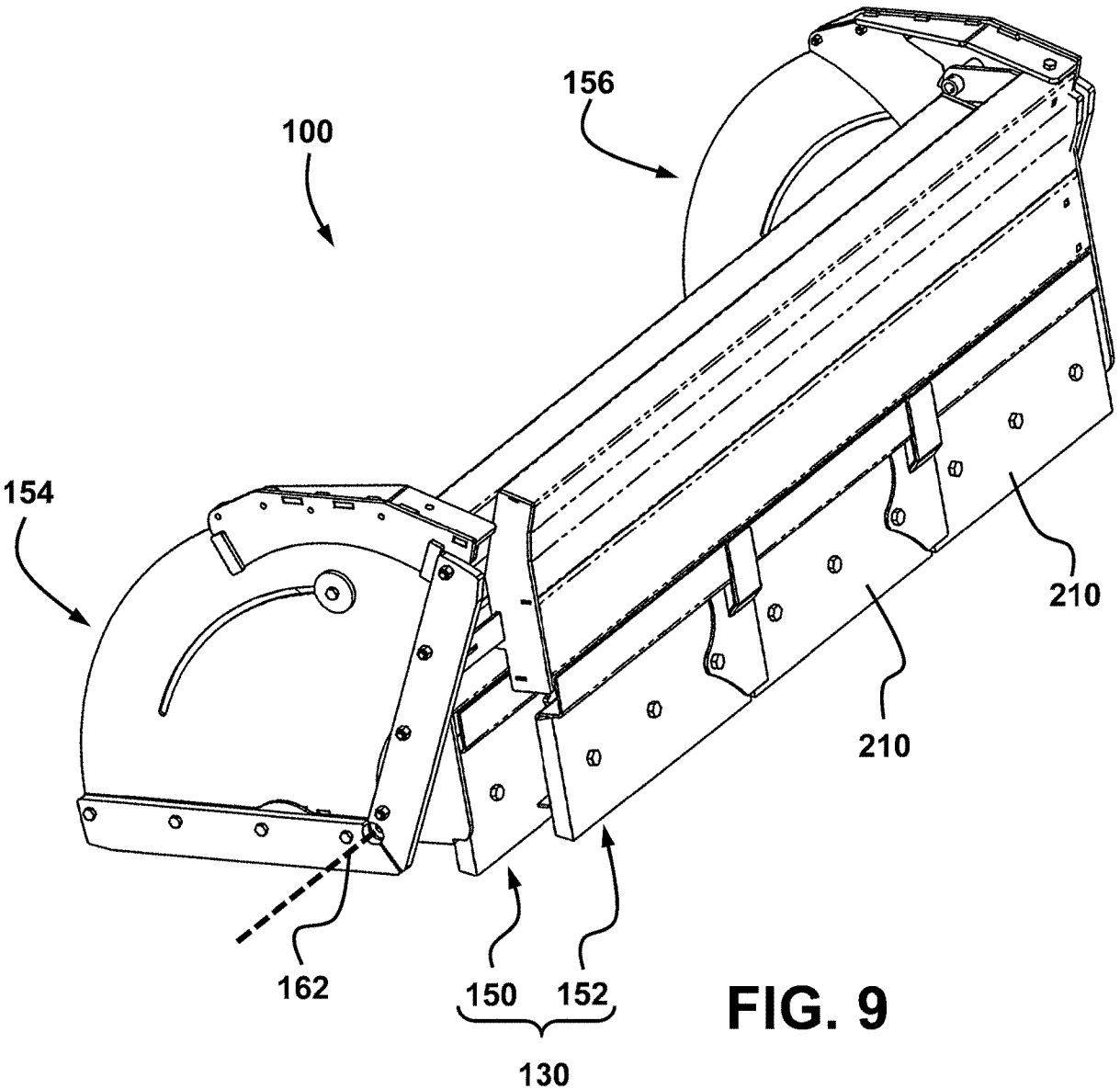
FIG. 9 is an isometric front view in which the scraper blade device of FIG. 1 is now in a collapsed position.
Figure 10:
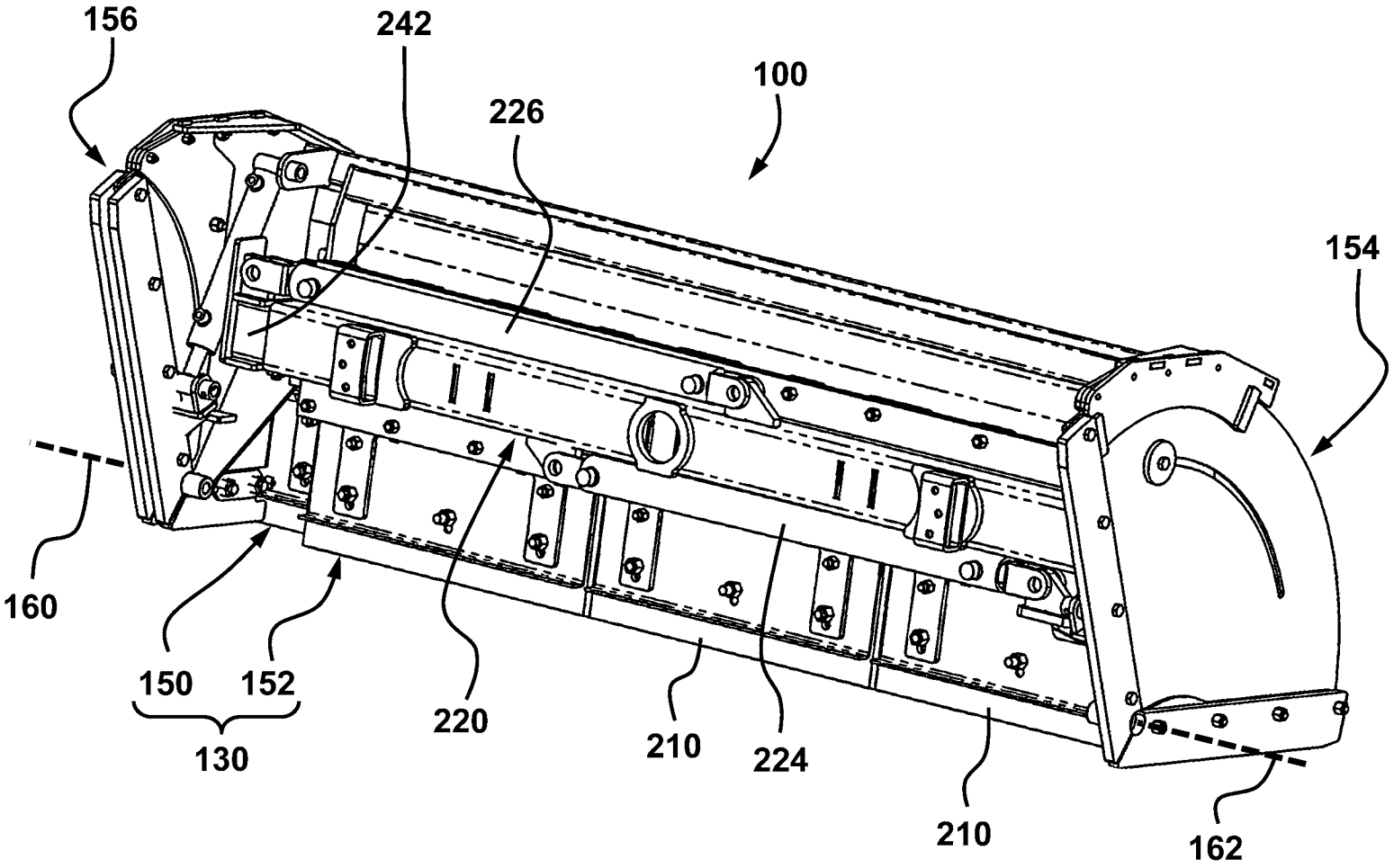
FIG. 10 is an isometric rear view of the scraper blade device in FIG. 9.
Figure 11:
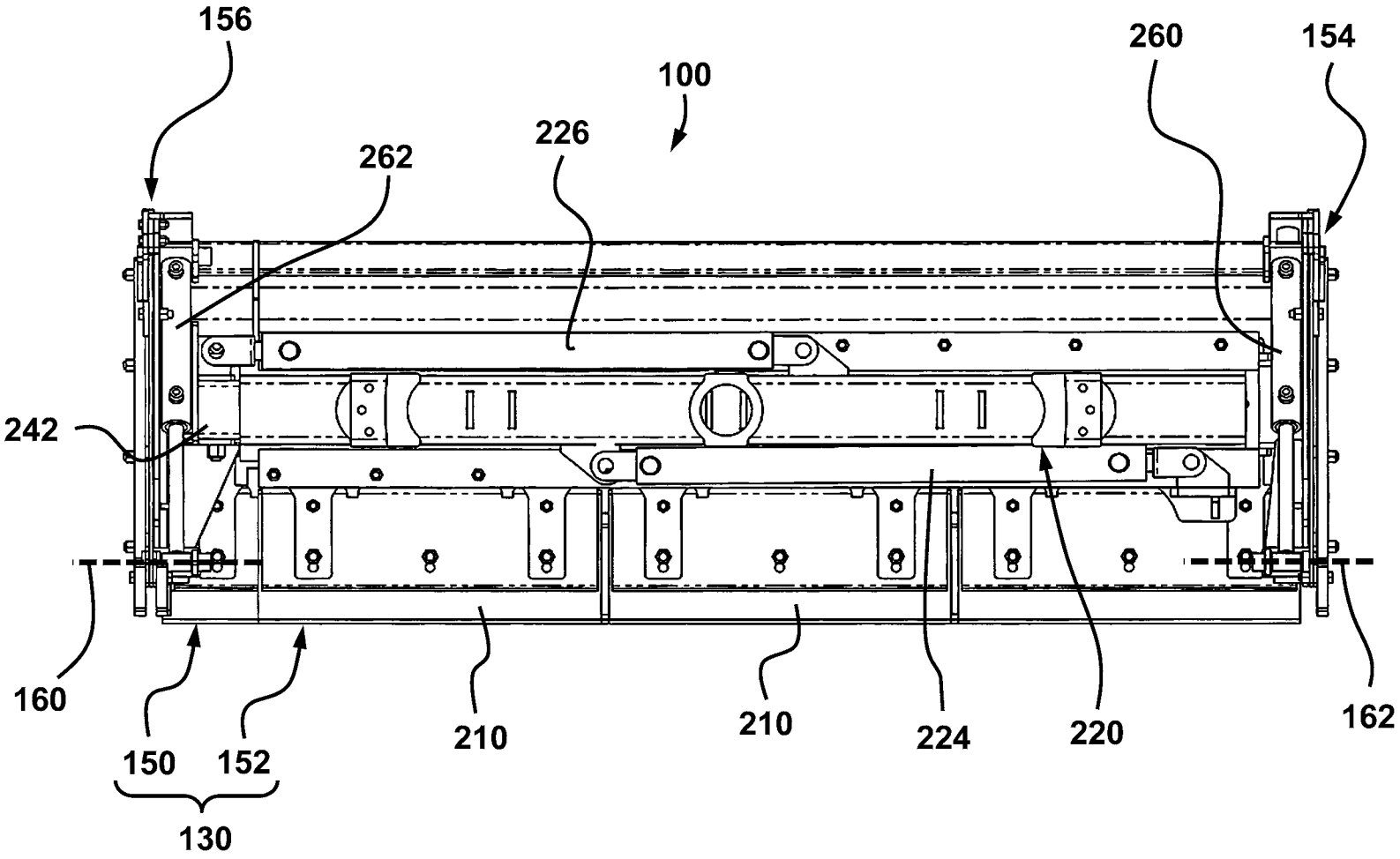
FIG. 11 is a rear view of the scraper blade device in FIG. 9.
Figure 12:
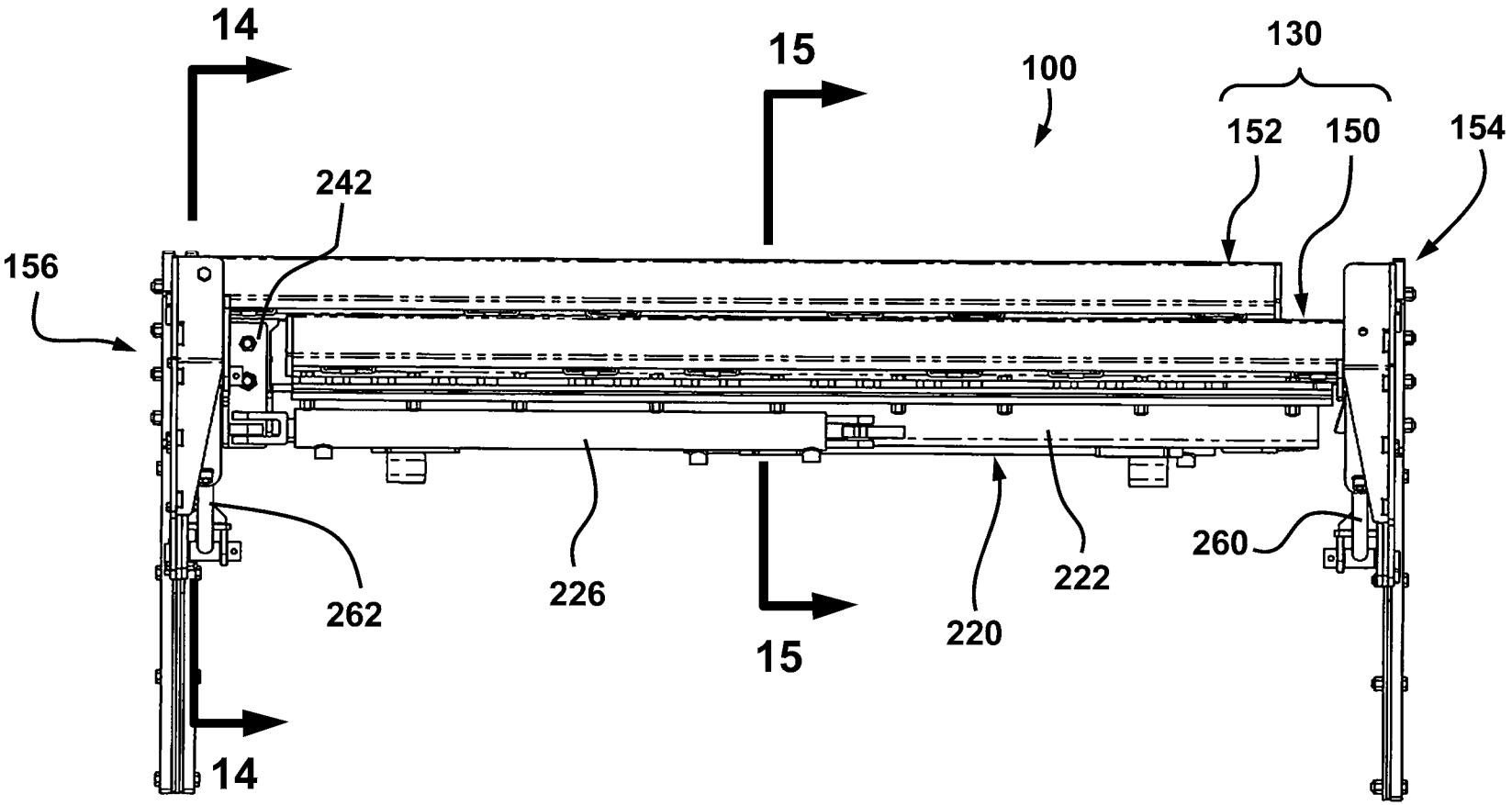
FIG. 12 is a top view of the scraper blade device in FIG. 9.

FIG. 9 is an isometric front view in which the scraper blade device 100 of FIG. 1 is now in a collapsed position. FIG. 10 is an isometric rear view of the scraper blade device 100 shown in FIG. 9. FIG. 11 is a rear view of the scraper blade device 100 shown in FIG. 9. FIG. 12 is a top view of the scraper blade device 100 shown in FIG. 9. As can be seen, the scraper blade device 100 is now smaller in width since, among other things, the two wing units 154, 156 are closer to one another compared to what is shown in FIG. 1. Other configurations and arrangements are possible.

FIG. 11 shows that the scraper blade device 100 of FIG. 1 includes actuators 260, 262 for pivoting the wing units 154, 156. The actuator 260 is located at the right and can pivot the right wing unit 154 around the first pivot axis 160. The actuator 262 is located at the left and can pivot the left wing unit 156 around the second pivot axis 162. Other configurations and arrangements are possible.

FIG. 13 is an isometric cross-section view of the scraper blade device 100 taken approximately at the center thereof. FIG. 14 is a cross-section view of the scraper blade device 100 taken along line 14-14 in FIG. 12. The right wing unit 154 is not shown in FIG. 14.

As can be seen, the upper section 200 of the illustrated right moldboard unit 150 can include one or more front panels 270. Likewise, the upper section 200 of the left moldboard unit 152 can include one or more front panels 272. These panels 270, 272 are configured and disposed so as to form the upper part of the front plow surface 132. The panels 270, 272 can extend substantially over the entire width of the corresponding moldboard units 150, 152. They can also include multiple facets and a top rectangular-shaped bended edge, as shown in the illustrated example, for adding rigidity and strength to the structure or for other purposes. The panels 270, 272 can be made of different materials, for instances steel, stainless steel or a polymer, to name just a few. Other configurations, arrangements and materials are also possible. One or more of the panels 270, 272, or even all of them, can be replaced by another part or be entirely omitted.

In the illustrated example, the bottom edge of the front panels 270, 272 is rigidly attached to a corresponding crossbeam 280, 282 located above the blade segments 210. These crossbeams 280, 282 can have a tubular construction and thus include a hollow interior. Other configurations and arrangements are possible.

In use, the blade segments 210 are movable between a downward extended position and an upward retracted position. The blade segments 210 are biased towards the downwardly extended position using a plurality of first and second force-generating mechanisms 290, 292. The blade segments 210 on the right moldboard unit 150 are biased by the first force-generating mechanisms 290 and the blade segments 210 on the left moldboard unit 152 are biased by the second force-generating mechanisms 292. Each force-generating mechanism 290, 292 can include, for instance, one or more compression helical springs. Other kinds of force-generating mechanisms can be used as well, including ones where no mechanical springs are used, such as pneumatic actuators, hydraulic actuators and others. Some implementations may have only the first force-generating mechanisms 290 or only the second force-generating mechanisms 292. Other variants are possible as well.

In the illustrated example, the first force-generating mechanisms 290 are spaced apart from one another and they are extending vertically inside the right crossbeam 280. Likewise, the second force-generating mechanisms 292 are spaced apart from one another and they are extending vertically inside the left crossbeam 280. Each force-generating mechanism 290, 292 is mechanically connected to a corresponding one of the blade segments 210 using a support member 300, 302. Other configurations and arrangements are possible. For instance, the force-generating mechanisms 290, 292 can be provided elsewhere in some implementations and the mechanical connections with the blade segments 210 can be provided by other kinds of supports. The right and left moldboard units 150, 152 can also have completely different arrangements. Other variants are possible as well.

Figure 15:
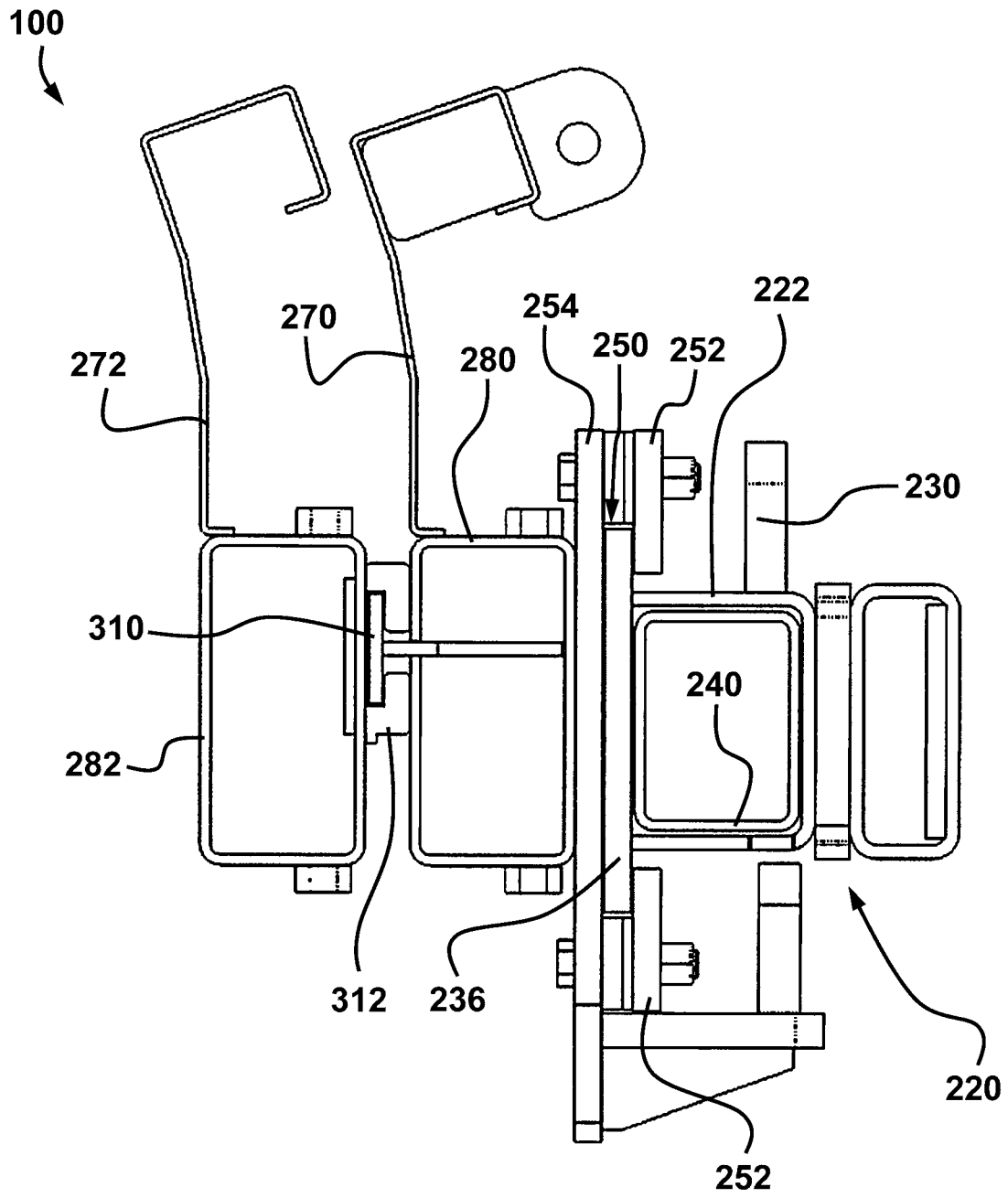
FIG. 15 is a cross-section view of the scraper blade device taken along line 15-15 in FIG. 12.

FIG. 15 is an enlarged cross-section view of the scraper blade device 100 taken along line 15-15 in FIG. 12. Only some of the parts are shown for the sake of simplicity.

A guiding arrangement can be provided on the scraper blade device 100 to support the left moldboard unit 152 vertically when its blade segments 210 are out of engagement with the roadway surface 104 and to keep the two moldboard units 150, 152 parallel to one another, particularly when the scraper blade device 100 moves in the rearward travel direction 112 while the blade segments 210 of the left moldboard unit 152 are in engagement with the roadway surface 104. The guiding device can include at least one follower 310 projecting in front of the right crossbeam 280, as shown in the illustrated example. The follower 310 can include a stem-like portion that is rigidly attached to the front of the right crossbeam 280, as shown. The follower 310 of this example also includes an enlarged head portion located at the front end of the stem-like portion. This head portion is slidingly engaged inside a corresponding track 312 transversally extending on the rear side of the left beam 282. The track 312 can be formed by two spaced-apart L-shaped strips that are parallel to one another. The various parts are configured and disposed so that the head portion of the follower 310 can slide along the track 312 when they move with reference to one another. The track 312 can receive multiple spaced-apart followers like the follower 310. Some grease can be added to facilitate the sliding movements in some implementations. Other configurations and arrangements are possible. For instance, the head portion can include a roller or another feature. The guiding device can also be omitted in some implementations. Other variants are possible as well.

FIG. 16 is a partial left-end view of the right moldboard unit 150 in FIG. 9. The right wing unit 154 is not shown, as well as the elongated member 192 and the lateral plate 194. Only the inner plate 196 is illustrated. The inner plate 196 is where the inner portion of the right or left pivots 164, 166 are attached. Other configurations and arrangements are possible.

FIG. 17 is a partial right-end view of the left moldboard unit 152 in FIG. 9. The view in FIG. 17 is the equivalent to the left of what is shown in FIG. 16. The left wing unit 156 of the illustrated example has a similar design to that of the right wing unit 154. This is why it also includes an inner plate 196. Other configurations and arrangements are possible.

Overall, the proposed concept provides a way to further maintain the efficiency of the cleaning even when the blade width is fully extended. Among other things, it is now possible to construct scraper blade devices that are very large in width when fully extended, for instance larger than one vehicle lane, and still have a very good cleaning efficiency. This can also yield several other advantages, including for instance reducing the quantity of de-icing chemicals released in the environment, increasing road safety, decreasing the number of vehicles to clean highways or other roadways during or after a snowstorm, increasing travel speeds of the scraper blade devices during operations, mitigating damages and wear to the roadway surfaces, etc.

The scraper blade device 100 can be made using a manufacturing process that includes any one of the following acts or combinations thereof: cutting, bending, punching, welding, bolting, gluing, painting.

The present detailed description and the appended figures are meant to be exemplary only, and a skilled person will recognize that variants can be made in light of a review of the present disclosure without departing from the proposed concept. Among other things, and unless otherwise explicitly specified, none of the parts, elements, characteristics or features, or any combination thereof, should be interpreted as being necessarily essential to the invention simply because of their presence in one or more examples described, shown and/or suggested herein.

LIST OF REFERENCE NUMERALS

100 scraper blade device
100*a* lowermost edge (of the scraper blade device)
102 vehicle
104 roadway surface
110 forward travel direction
112 rearward travel direction
114 longitudinal axis
116 transversal axis
120 right end (of the scraper blade device)
122 left end (of the scraper blade device)
130 moldboard
132 front plow surface
134 rear plow surface
140 coupling assembly
150 right moldboard unit
152 left moldboard unit
154 right wing unit
156 left wing unit
160 first pivot axis
162 second pivot axis
164 right pivot
166 left pivot
170 panel (of the wind units)
172 front skid member
174 rear skid member
176 fastener
180 slot
182 follower
190 arc-shaped edge
192 outer member
194 lateral plate
196 inner plate
200 upper section
202 bottom section
210 blade segment
212 cover plate
220 main transversal support
222 main elongated beam
224 first actuator (of main transversal support)
226 second actuator (of main transversal support)
228 bottom flange (on main elongated beam)
230 upper flange (on main elongated beam)
232 body (of main elongated beam)
234 inner space
236 front wall (of main elongated beam)
240 cantilever beam
242 beam base
250 track
252 member (to form the track 250)
254 transversal plate
260 actuator (for the right wing unit)
262 actuator (for the left wing unit)
280 right crossbeam
282 left beam
270 right front panel
272 left front panel
290 first force-generating mechanism
292 second force-generating mechanism
300 first support member
302 second support member
310 follower
312 track

What is claimed is:

1. A width-adjustable scraper blade device for cleaning a roadway surface, the scraper blade device having a lowermost edge, the scraper blade device comprising:

a main transversal support;

an elongated moldboard generally extending along a transversal axis, the moldboard including two partially overlapping elongated moldboard units, one moldboard unit being on a right side and another moldboard unit being on a left side of the moldboard, the moldboard units being slidably mounted to one another and one of the moldboard units being slidably mounted to a front side of the main transversal support, the moldboard units being movable with reference to one another at least between an extended position and a collapsed position, each moldboard unit comprising an upper section and a bottom section, the bottom section including a plurality of widthwise-disposed and juxtaposed blade segments, each blade segment including a bottom surface-engaging edge and the bottom surface-engaging edges of the blade segments of the two moldboard sections forming together the lowermost edge of the scraper blade device, each blade segment being operatively connected to the upper section and the bottom surface-engaging edges of the blade segments being tiltable with reference to one another about a tilt axis orthogonal to the transversal axis to follow profile variations of the roadway surface;

a right wing unit having a first pivot axis substantially parallel to the transversal axis and being pivotally connected to an outer end of the right moldboard unit for pivoting the right wing unit towards a front direction or a rear direction; and a left wing unit having a second pivot axis substantially parallel to the transversal axis and being pivotally connected to an outer end of the left moldboard unit for pivoting the right wing unit towards a front direction or a rear direction.

2. The scraper blade device as defined in claim 1, wherein the scraper blade device includes actuators.

3. The scraper blade device as defined in claim 2, wherein at least one of the actuators is a hydraulic actuator.

4. The scraper blade device as defined in claim 1, wherein the scraper blade device includes force-generating mechanisms.

5. The scraper blade device as defined in claim 4, wherein at least some of the force-generating mechanisms include a compression spring.

6. A width-adjustable scraper blade device for cleaning a roadway surface, the scraper blade device having a lowermost edge, the scraper blade device comprising:

a main transversal support;

an elongated moldboard generally extending along a transversal axis, the moldboard including two partially overlapping elongated moldboard units, one moldboard unit being on a right side and another moldboard unit being on a left side of the moldboard, the moldboard units being slidably mounted to one another and one of the moldboard units being slidably mounted to a front side of the main transversal support, the moldboard units being movable with reference to one another at least between an extended position and a collapsed position, each moldboard unit comprising:

an upper section and a bottom section, the bottom section including a plurality of widthwise-disposed and juxtaposed blade segments, each blade segment including a bottom surface-engaging edge and the bottom surface-engaging edges of the blade segments of the two moldboard sections forming together the lowermost edge of the scraper blade device, each blade segment being operatively connected to the upper section and the bottom surface-engaging edges of the blade segments being tiltable with reference to one another about a tilt axis orthogonal to the transversal axis to follow profile variations of the roadway surface; and a plurality of spaced-apart force-generating mechanisms mounted between the upper section and the bottom section to exert return forces urging the blade segments downward;

a right wing unit having a first pivot axis substantially parallel to the transversal axis and being pivotally connected to an outer end of the right moldboard unit for pivoting the right wing unit towards a front direction or a rear direction;

a left wing unit having a second pivot axis substantially parallel to the transversal axis and being pivotally connected to an outer end of the left moldboard unit for pivoting the right wing unit towards a front direction or a rear direction;

a first actuator mounted between the main transversal support and the right moldboard unit;

a second actuator mounted between the main transversal support and the left moldboard unit;

a third actuator mounted between the right wing unit and the right moldboard unit; and a fourth actuator mounted between the left wing unit and the left moldboard unit.

7. The scraper blade device as defined in claim 6, wherein at least one of the actuators is a hydraulic actuator.

8. The scraper blade device as defined in claim 6, wherein at least some of the force-generating mechanisms include a helical compression spring.

* * * * *